US009152064B2

(12) United States Patent
Suzuki et al.

(10) Patent No.: US 9,152,064 B2
(45) Date of Patent: Oct. 6, 2015

(54) METHOD OF PREPARING DEVELOPER, DEVELOPER FOR ELECTROPHOTOGRAPHY, PROCESS CARTRIDGE AND IMAGE FORMING APPARATUS

(71) Applicants: Kousuke Suzuki, Shizuoka (JP); Yuuki Mizutani, Shizuoka (JP); Shinichiro Yagi, Shizuoka (JP)

(72) Inventors: Kousuke Suzuki, Shizuoka (JP); Yuuki Mizutani, Shizuoka (JP); Shinichiro Yagi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/961,093

(22) Filed: Aug. 7, 2013

(65) Prior Publication Data

US 2014/0080045 A1 Mar. 20, 2014

(30) Foreign Application Priority Data

Sep. 14, 2012 (JP) ..... 2012-203652
Mar. 8, 2013 (JP) ..... 2013-047021

(51) Int. Cl.
*G03G 5/00* (2006.01)
*G03G 9/08* (2006.01)
*G03G 9/10* (2006.01)

(52) U.S. Cl.
CPC ..... *G03G 9/0808* (2013.01); *G03G 9/08* (2013.01); *G03G 9/10* (2013.01)

(58) Field of Classification Search
CPC ..... G03G 9/00; G03G 9/0808
USPC ..... 430/117.1, 123.53, 124.3, 105, 137.21, 430/137.1, 123.41; 399/237
See application file for complete search history.

(56) References Cited

U.S. PATENT DOCUMENTS

| | | | | |
|---|---|---|---|---|
| 4,207,009 | A * | 6/1980 | Glocker | 366/337 |
| 4,996,126 | A * | 2/1991 | Anno et al. | 430/111.3 |
| 2012/0008979 | A1 | 1/2012 | Suzuki et al. | |
| 2012/0264042 | A1 | 10/2012 | Taikoji et al. | |

FOREIGN PATENT DOCUMENTS

| | | |
|---|---|---|
| JP | 5-015063 | 2/1993 |
| JP | 5-303235 | 11/1993 |
| JP | 7-281482 | 10/1995 |
| JP | 9-006041 | 1/1997 |
| JP | 2001-125317 | 5/2001 |
| JP | 2003-126666 | 5/2003 |
| JP | 2007-156269 | 6/2007 |
| JP | 2008-020795 | 1/2008 |
| JP | 2008-073573 | 4/2008 |
| JP | 2010-282168 | 12/2010 |
| JP | 2012-032769 | 2/2012 |

* cited by examiner

*Primary Examiner* — Thorl Chea
(74) *Attorney, Agent, or Firm* — Oblon, McClelland, Maier & Neustadt, L.L.P.

(57) ABSTRACT

A method of preparing a developer includes mixing a carrier and a powder with each other while falling with gravity.

20 Claims, 16 Drawing Sheets

METHOD OF PREPARING DEVELOPER, DEVELOPER FOR ELECTROPHOTOGRAPHY, PROCESS CARTRIDGE AND IMAGE FORMING APPARATUS

CROSS-REFERENCE TO RELATED APPLICATIONS

This patent application is based on and claims priority pursuant to 35 U.S.C. §119 to Japanese Patent Applications Nos. 2012-203652 and 2013-047021, filed on Sep. 14, 2012 and Mar. 8, 2013, respectively in the Japan Patent Office, the entire disclosure of which is hereby incorporated by reference herein.

BACKGROUND

1. Technical Field

The present invention relates to a method of preparing an electrophotographic developer outside of an image developer, in which a powder such as a toner and a carrier which are constituents of the developer are mixed. In addition, the present invention relates to an electrophotographic developer prepared by the method, and a process cartridge and an image forming apparatus using the electrophotographic developer.

2. Description of the Related Art

In electrophotographic image forming apparatuses used in copiers, printers, facsimiles, etc., a developer has an important part to play in finally visualizing an image. A dry two-component developer in the current mainstream include magnetic particles called a carrier and resin particles including a colorant, which is called a toner.

The two-component developer preferably includes a toner at a uniform concentration. Therefore, in the process of preparing a developer contained in an image developer before use (hereinafter referred to as an "initial developer"), it is required to uniformly mix a toner and a carrier.

Japanese published unexamined applications Nos. JP-2008-020795-A and JP-2001-125317-A disclose a mixing process using a mixer rotating a mixing container a toner and a carrier are fed in. Japanese published unexamined application No. JP-H07-281482-A discloses a mixing process using a mixer rotating a stirring blade located in a mixing container a toner and a carrier are fed in.

The mixers disclosed in Japanese published unexamined applications Nos. JP-2008-020795-A, JP-2001-125317-A and JP-H07-281482-A need increasing the rotational number or time of the container and the stirring blade to more uniformly mix a toner and a carrier. To increase the rotational number or time needs increasing power of a drive source or drive time, resulting in increase of consumption energy of the drive source, i.e., increase of energy required to prepare a developer.

A powder mixed with a carrier in preparing a developer is not limited to a toner. The same problems could occur when a powder such as inorganic oxidized particles besides a toner and a carrier are uniformly mixed.

The initial developer has been explained. A developer for supply, called a "premix toner" including a toner more than the initial developer, increasing a concentration of a toner of a developer in an image developer when fed therein, and feeding a new carrier therein could have the same problem.

Because of these reasons, a need exist for a method of preparing a developer, which is capable of saving energy required in the process of mixing a powder and a carrier.

SUMMARY

Accordingly, one object of the present invention is to provide a method of preparing a developer, which is capable of saving energy required in the process of mixing a powder and a carrier.

Another object of the present invention is to provide a developer prepared by the method.

A further object of the present invention is to provide a process cartridge using the developer.

Another object of the present invention is to provide an image forming apparatus using the developer.

These objects and other objects of the present invention, either individually or collectively, have been satisfied by the discovery of a method of preparing the developer, including mixing a carrier and a powder with each other while falling with gravity.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

The present invention provides a method of preparing a developer, which is capable of saving energy required in the process of mixing a powder and a carrier.

Hereinafter, an embodiment of the present invention applied to an electrophotographic copier (hereinafter referred as a copier 500) is explained.

Figure 2:
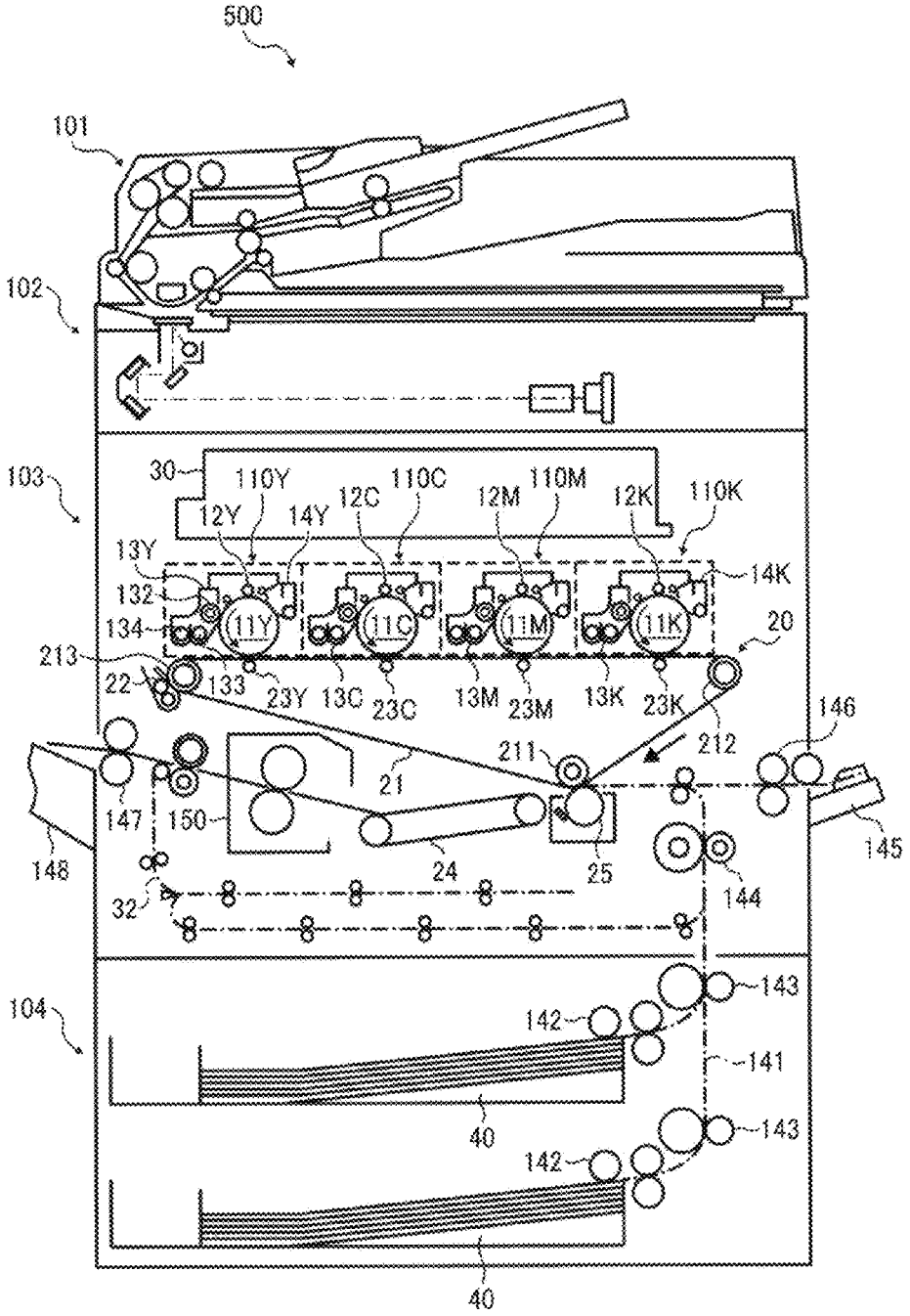
FIG. 2 is a schematic view illustrating an embodiment of image forming apparatus of the present invention.

FIG. 2 is a schematic view explaining configuration of the copier 500.

As FIG. 2 shows, the copier 500 includes an automatic document feeder (ADF) 101 feeding a document, a scanner 102 scanning an image on the document, an image former 103 forming an image based on image data scanned by the scanner 102 and a paper feeder 104 feeding a transfer paper to the image former 103.

As FIG. 2 shows, the image former 103 includes four process cartridges 110 (K, M, C and Y) forming respective black, magenta, cyan and yellow toner images. K, M, C and Y represent magenta, cyan and yellow colors, respectively.

Figure 3:
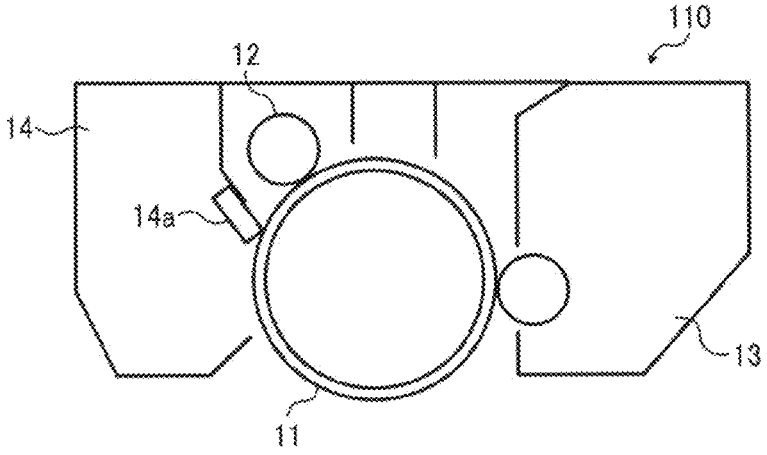
FIG. 3 is a schematic view illustrating an embodiment of process cartridge of the present invention.

FIG. 3 explains one of the four process cartridges 110 (K, M, C and Y), and they have almost the same configurations except for toner color and subscripts representing respective colors are omitted in FIG. 3 and properly omitted hereafter.

Each of the four process cartridges 110 includes a photoreceptor 11 bearing an each color toner image. Around each of the photoreceptors 11, a charger 12, an image developer 13, a photoreceptor cleaner 14, etc. are located. The charger 12 uniformly charges the surface of the photoreceptor 11 and the image developer 13 develops an electrostatic latent image formed on the surface of the photoreceptor 11. The photoreceptor cleaner 14 cleans the surface of the photoreceptor 11 after a toner image is transferred.

The process cartridge 110 is a process cartridge including the photoreceptor 11 and other units such as the charger 12, the image developer 13 and the photoreceptor cleaner 14, etc., and is detachable from the image former 103.

The image former 103 includes an optical writer 30 irradiating the surface of the photoreceptor 11, which is uniformly charged by the charger 12 with a laser beam including image information to form an electrostatic latent image thereon. The optical writer 30 includes a laser beam source, a polygon mirror, an f-θ lens, a reflection mirror, etc., and irradiates the surface of the photoreceptor 11 which is driven to rotate while scanning in a main scanning direction with a laser beam, based on image data at a predetermined irradiating position.

Further, the image former 103 includes a transfer unit 20 transferring a toner image formed on the photoreceptor 11 onto a transfer paper and a fixer 150 fixing the toner image thereon.

The transfer unit 20 includes an intermediate transfer belt 21 driven to rotate in an arrow direction, which is extended by plural extension rollers 211, 212 and 213 with tension. The transfer unit 20 forms a first transfer nip, sandwiching the intermediate transfer belt 21 between the four photoreceptors 11 and four first transfer rollers 23 a predetermined voltage is applied to. In addition, the transfer unit 20 forms a second transfer nip, sandwiching the intermediate transfer belt 21 between the second backup roller 211 and a second transfer roller 25 a predetermined voltage is applied to.

Further, the transfer unit 20 includes a belt cleaner 22 removing an untransferred toner remaining on the intermediate transfer belt 21.

Each of the four image developers 13 installed in the each of the four process cartridges 110 includes a negatively-charged different color toner with a carrier. The image developer 13 includes a developing sleeve 132 facing the photoreceptor 11 and bearing a developer on its surface with a magnetic field generator included therein. In addition, the image developer 13 includes two screw members 133 and 134 mixing a toner fed from an unillustrated toner bottle with a two-component developer included in the image developer 13 and transferring the developer while stirring. The developing sleeve 132 draws a two-component developer including a toner and a carrier onto its surface while rotating like surface movement at a position facing the photoreceptor 11 in the same direction, and feeds the toner to a latent image on the surface of the photoreceptor 11 to form a toner image.

Each of color toner images formed on the photoreceptor 11 is sequentially transferred onto the intermediate transfer belt 21 where they are overlapped at the first transfer nip. The overlapped four color toner images formed on the intermediate transfer belt 21 are transferred onto a transfer paper at a time at the second transfer nip. After this, an untransferred toner remaining on the intermediate transfer belt 21 is removed by the belt cleaner 22.

Below the transfer unit 20, the fixer 150, a paper feed unit 24 and a pair of registration rollers 144 are located. The paper feed unit 24 endlessly moves an endless paper feed belt suspended between the second transfer roller 25 and the fixer 150. The pair of registration rollers 144 sandwiches a transfer paper fed from the paper feeder 4 between the rollers and feed the transfer paper to the second transfer nip in synchronization with the four color toner images formed on the intermediate transfer belt 21. A transfer paper a full-color image is transferred on, having passed the second transfer nip is released from the intermediate transfer belt 21 and fed to the fixer 150 by the paper feed unit 24. A transfer paper fed to the fixer 150, after a full-color image is fixed thereon with heat and pressure therein, is fed to a pair of paper discharge rollers 147 to be discharged on a paper discharge tray 148.

Below the image former 103, a both side feeder 32 is located. The both side feeder 32 changes over the direction of a transfer paper an image is fixed on one side thereof to a transfer paper reverser such that the transfer paper is reversed to enter the second transfer nip again.

The paper feeder 4 includes multi-stage paper feed cassettes 40 each containing a batch of paper including plural transfer papers, and a paper feed roller 142 is pressed against the uppermost transfer paper in the paper feed cassette 40. When the selected paper feed roller 142 is driven to rotate, the uppermost transfer paper is separated by a separation roller and fed to a paper feed path 141 one by one. The transfer paper fed to the paper feed path 141 is led to a paper feed path in an image forming unit 1 through plural pair of feed rollers 143, and sandwiched between a pair of registration rollers 144.

In the image former 103, an image is formed as follows.

In the process cartridge 110*k* for black, e.g., a laser beam modulated and deflected by the optical writer 30 is irradiated on the surface of the photoreceptor 11K uniformly charged by the charger 12K while scanned to form an electrostatic latent image. The electrostatic latent image on the photoreceptor 11K is developed by the image developer 13K to form a black toner image. The toner image on the photoreceptor 11K is transferred onto a transfer paper at the first transfer nip facing the first transfer roller 23K through the intermediate transfer belt 21. The surface of the photoreceptor 11K after the toner image is transferred is cleaned by the cleaner 14*k* and prepared for forming the following electrostatic latent image.

The other process cartridges 110M, 110C and 110Y perform the same image forming process in synchronization with the intermediate transfer belt 21. A transfer paper fed from the paper feed cassette 40 is fed out by the pair of registration rollers 144 at a predetermined timing to the second transfer nip. Alternatively, a transfer paper fed from a manual tray 145 located at a side of the image former 103 is fed in a manual paper feed path by a paper feed roller, and fed out by pair of registration rollers 146 at a predetermined timing to the second transfer nip.

The transfer paper a full-color image is transferred on at the second transfer nip at a time is fed by the paper feed unit 24 to the fixer 150 where the toner image is fixed. In one-side print mode printing only on one side of the transfer paper, the transfer paper sandwiched in a paper discharge nip between the pair of paper discharge rollers 147 is discharged out of the apparatus and stacked on the paper discharge tray 148. In both-side print mode printing on both sides of the transfer paper, the transfer paper sandwiched between the pair of paper discharge rollers 147 is returned in a reverse direction and enters the both side feeder 32. In the both side feeder 32, the transfer paper is reversed and fed to the second transfer nip again. After the second transfer and fixation are performed on the other side of the transfer paper, the transfer paper is discharged by the pair of paper discharge rollers 147 onto the paper discharge tray 148. A residual toner remaining on the intermediate transfer belt 21 after the toner image is transferred is removed by the cleaned by the belt cleaner 22 and prepared for the following image formation of the process cartridge 110.

The above-mentioned image formation is an operation in overlapped four color (full-color) mode. In black and white image forming mode, among the extension rollers for the intermediate transfer belt 21, the extension rollers 212 or 213 besides the second transfer backup roller 211 is moved to separate the photoreceptors 11 (Y, M and C) from the intermediate transfer belt 21, and only a K toner image is formed thereon.

Next, a method of preparing a two-component developer used in the copier 500 is explained.

An embodiment of the method of preparing a developer of the present invention is a method of preparing an electrophotographic developer including a powdery toner and a carrier, in which at least a process of mixing the toner and the carrier is a process of mixing by gravity fall.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Embodiment 1

Figure 1:
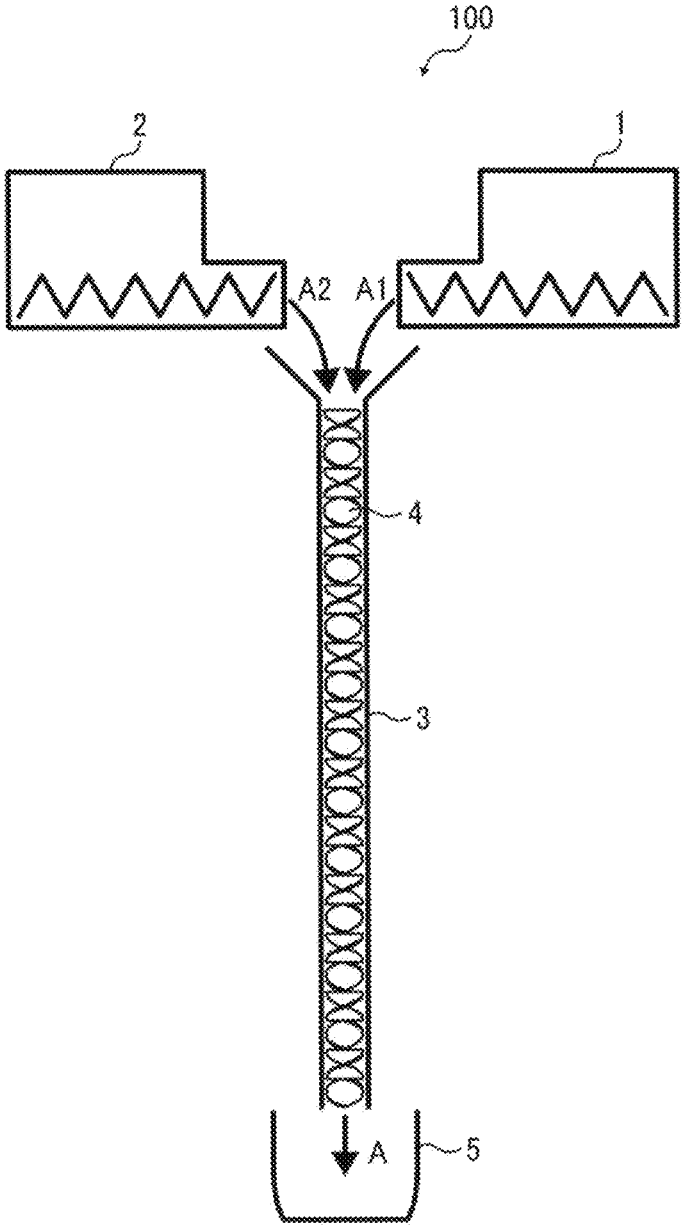
FIG. 1 is a schematic view illustrating an embodiment of gravity fall mixer of the present invention.

FIG. 1 is a schematic view illustrating an embodiment of gravity fall mixer of the present invention.

In FIG. 1, an arrow A1 is a flow of a carrier, A2 is a flow of a toner and A is a flow of a developer including the carrier and the toner.

As FIG. 1 shows, a gravity fall mixer 100 includes a carrier feeder 1, a toner feeder 2, a mixing pipe 3 and a developer container 5. The mixing pipe 3 includes a ribbon-type direction control member 4 having a twisted shape.

The carrier feeder 1 feeds the carrier, i.e., magnetic particles into the mixing pipe 3, and the toner feeder 2 feeds the toner thereinto. In the mixing pipe 3, the carrier and the toner fed therein are mixed while falling with gravity to form a developer, which is fed into the developer container 5 from the mixing pipe 3.

The gravity fall mixer 100 is a mixer using the force of gravity having the carrier and the toner fall to mix them. They are mixed with each other in the mixing pipe 3 while falling with the force of gravity.

Further, a direction controller such as the ribbon-type direction control member 4 located in the mixing pipe 3 more effectively mix the carrier and the toner. The direction controller is capable of freely controlling movements thereof, i.e., complicating movements of the particles by dividing a bulk of powders, changing moving directions of particles and reducing falling speed thereof to promote mixing.

The gravity fall mixer 100 more effectively mixes particles when using one of a twisted member, a plurally-divided member, a sifter-type member and an area-reduction type member or a combination thereof as a direction controller. The direction controller in the mixing pipe 3 freely controls movements of carrier and the toner and complicates movements thereof to promote mixing. One of the four direction controllers or a combination thereof effectively mixes the particles. The direction controllers have different ways of mixing each other and a combination pattern and the number thereof are selected according to powder properties and desired mixing intensity.

Figure 4:
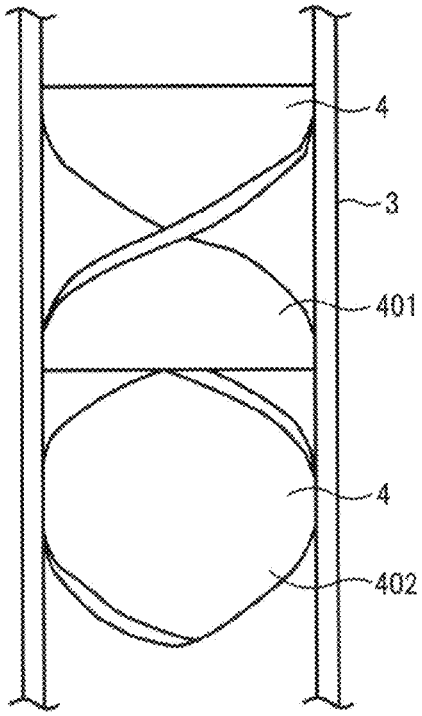
FIG. 4 is an amplified view illustrating a ribbon-type direction control member.

FIG. 4 is an amplified view illustrating a ribbon-type direction control member, which is a twisted member.

The ribbon-type direction control member is a twisted belt-shaped plate. The ribbon-type direction control member is capable of controlling mixing intensity when twisting direction is reversed, or the number and an aspect ratio of twisting are changed. The belt-shaped plate may be twisted properly and is preferably twisted at 180° (one segment). In FIG. 4, 401 is a right segment and 402 is a left segment.

The segments may properly be overlapped and preferably overlapped such that twisting directions alternate from side to side. The segments are preferably overlapped to have a shift of 90°, respectively. Every time the above segment transfers to the lower segment, particles are divided into half. Therefore, particles are divided into $2^{\text{the number of overlapped segments}}$. When 12 segments are overlapped, particles are divided into $2^{12}=4{,}096$. Further, since each segment is twisted, movements of particles are complicated and they are further mixed while transforming and reversing.

Figure 5A:
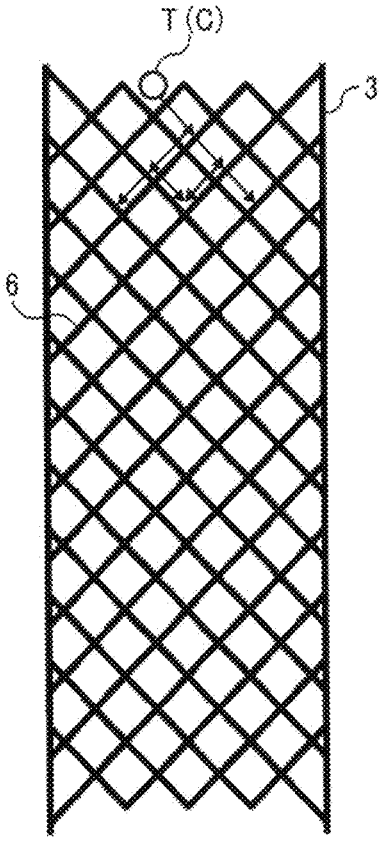
FIG. 5A is a side view.
Figure 5B:
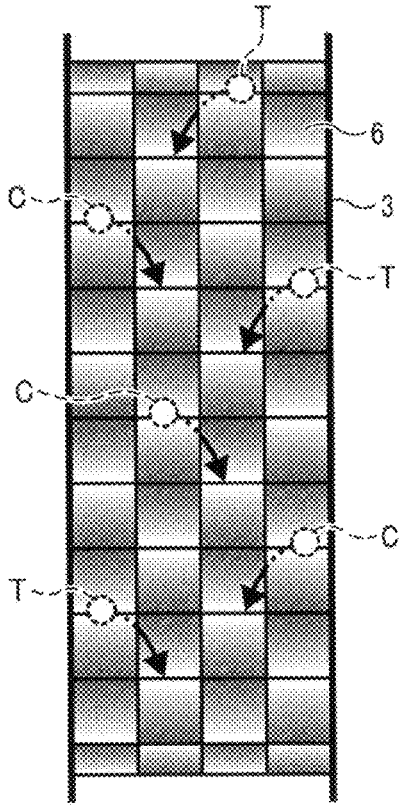
FIG. 5B is a side cross-sectional view and FIG. 5C is a upper cross-sectional view of a plurally-divided type direction control member.
Figure 5C:
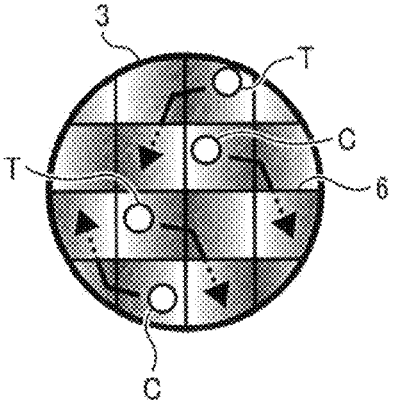

FIG. 5A is a side view, FIG. 5B is a side cross-sectional view and FIG. 5C is an upper cross-sectional view of a plurally-divided type direction control member 6.

The plurally-divided type direction control member 6 is formed of plural direction control plates and divides a passage route into plural routes. FIGS. 5A to 5C include plural flat direction control plates. Each of cells in FIGS. 5B and 5C is a direction control member having a gradation from white to dark gray. This is inclined downward from white to dark gray.

As FIGS. 5A to 5C show, falling directions of a toner T and a carrier C fed above the plurally-divided type direction control member 6 are controlled by the direction control plates thereof. The toner and the carrier repeat separating from and contacting with each other to be well mixed while falling.

The plurally-divided type direction control member 6 is capable of controlling mixing intensity by horizontally increasing the number of the control members and vertically overlapping them, but which is not limited thereto.

Figure 6A:
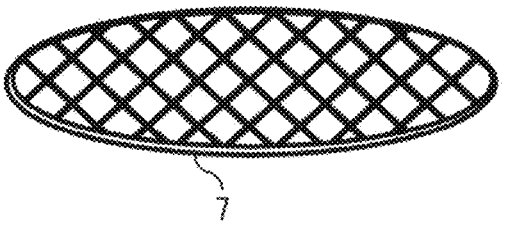
FIG. 6A is a perspective view and FIG. 6B is a side cross-sectional view of a sifter-type direction control member.
Figure 6B:
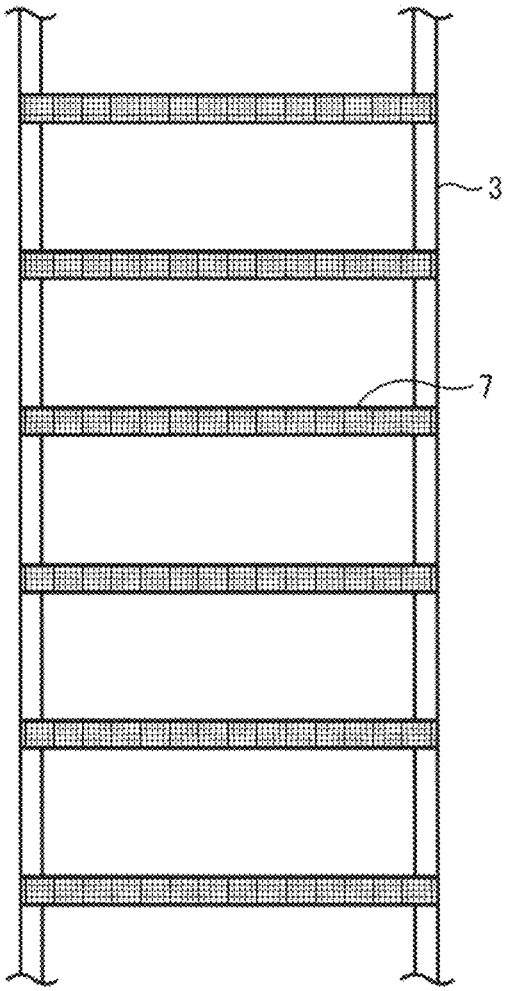

FIG. 6A is a perspective view and FIG. 6B is a side cross-sectional view of a sifter-type direction control member 7.

The sifter-type direction control member 7 is capable of controlling mixing intensity with sizes of openings of sifters, intervals thereof, the number thereof and angles thereof. Sifters having the same size of openings may be combined, and those having different sizes of openings each other may be combined, which largely improves mixing efficiency in some cases. However, combinations of sifters are not limited thereto.

Figure 7A:
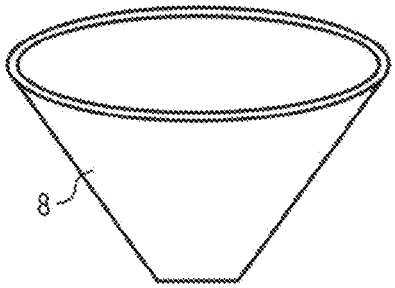
FIG. 7A is a perspective view and FIG. 7B is a side cross-sectional view of a reducer-type direction control member.
Figure 7B:
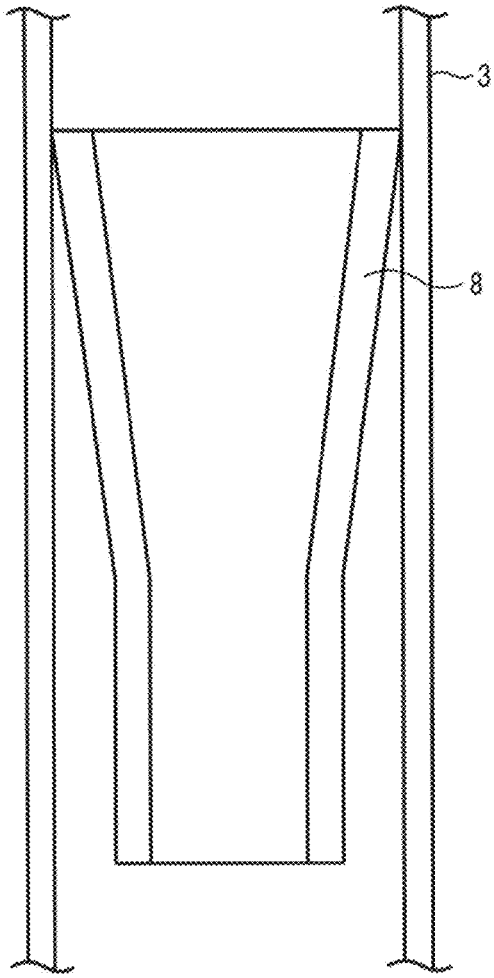

FIG. 7A is a perspective view and FIG. 7B is a side cross-sectional view of a reducer-type direction control member 8.

The reducer-type direction control member 8 has a shape of squeezing a passage route (mixing pipe 3) a toner and a carrier pass together to be narrowed in one direction. The reducer-type direction control member 8 is capable of controlling mixing intensity with an exit area smaller than an entrance area, a squeezing length and a shape of squeezing inner surface, but which is not limited thereto.

A developer is passed through the mixing pipe 3 because the developer powder inevitably flies or scatters out of the route if the passage route is an open route, and further, the powders are sparse and have less chance to contact each other.

The mixing pipe 3 prevents a toner and a carrier from flying or scattering out of the route. Further, the powders are dense and have much more chance to contact each other, and are well mixed because complexly intertwined with each other.

A powder mixed with a carrier is preferably a toner. Typically, a toner, an inorganic oxidized particulate material, and an inorganic oxidized particulate material, the surface of which is hydrophobized or treated to have lower resistivity are mixed with a carrier. A toner is most preferably mixed therewith because of the following reasons.

A toner has larger particle diameter than the inorganic oxidized particulate material, and the inorganic oxidized particulate material, the surface of which is hydrophobized or treated to have lower resistivity. Therefore, the toner has much less cohesive power due to van der Waals' force than the inorganic oxidized particulate materials and efficiently mixes with a carrier.

Further, a toner has larger charge quantity than the inorganic oxidized particulate materials and efficiently attracts the surface of a charged carrier. Therefore, toners are attracted to the surface of the carrier one after another.

The inorganic oxidized particulate materials have small particle diameter, and large cohesive power and lower charge quantity. Therefore, they are mixed less efficiently than a toner.

When a developer prepared by the method of the present invention is used in an image forming apparatus such as the copier 500, high-definition images are stably produced for long periods. This is because a carrier and a toner in the developer are uniformly mixed.

The developer may be a developer for supply (premix toner) including one part by weight of a carrier and 2 to 50 parts by weight of a toner.

In an image developer using a two-component developer, a toner in the developer is consumed to develop a latent image on the surface of a latent image bearer such as a photoreceptor and decreases in concentration. Therefore, a toner is supplied to the developer in the image developer to maintain a constant concentration of the toner for stably developing latent images.

A toner is consumed to develop latent images, but a carrier is not consumed and need not be supplied to the developer. However, when the same carrier continues to be used without being exchanged, poor images are produced due to low chargeability caused by deterioration of the carrier. In order to prevent this, instead of supplying a toner, it is known that a developer for supply having higher toner concentration, i.e., including fewer carriers than the initial developer is supplied. An image developer the developer for supply is fed in includes a developer exhaust. A new carrier is fed in the image developer and a developer including an old carrier is gradually exhausted from the developer exhaust when the developer for supply is fed therein. Thus, a carrier which is not consumed to develop is replaced.

The developer for supply preferably includes one part by weight of a carrier and 2 to 50 parts by weight of a toner. When less than 2 parts by weight, the developer includes a carrier so much that the developer is likely to increase charge quantity and the resultant image density varies. When greater than 50 parts by weight, the carrier is too few to exert a substantial effect thereof.

The image developer 13 of the process cartridge 110 detachable from the copier 500 contains a developer prepared by the method of the present invention.

When a deteriorated developer due to long-term use is replaced, it is not necessary to disassemble the image developer 13, take out the deteriorated developer, wash the image developer, place a new developer therein and reassemble. The whole process cartridge is replaced to replace the image developer 13 including the deteriorated developer without particular knowledge, technique and environment.

The process cartridge of the present invention includes at least one of a latent image bearer, a charger, an irradiator, a transferer and a cleaner, and an image developer, detachable from image forming apparatus.

Resins forming the coated layer of the carrier of the present invention include, but are not particularly limited to, if typically used for the carrier such as silicone resins, fluorine-containing resins and acrylic resins. These resins can be used alone or in combination, and can also be modified.

Specific examples of the core material for the carrier of the present invention include, but are not limited to, known carriers for electrophotographic two-component developers, such as iron, ferrite, magnetite, hematite, cobalt, Mn—Mg—Sr ferrite, Mn ferrite, Mn—Mg ferrite, Li ferrite, Mn—Zn ferrite, Cu—Zn ferrite, Ni—Zn ferrite and Ba ferrite, which can be selected in accordance with usage.

The following is an example of methods of preparing the carrier of the present invention, but the methods thereof are not limited thereto.

This is an outline of a method of preparing the carrier.

Measurement of materials→dispersing a coating liquid→coating→burning→sifting

Namely, materials measured to have desired ratios are dispersed by a disperser to prepare a dispersion. Specific examples of the disperser include any typically-used dispersers such as homomixers, rotary blade dispersers (Ebara Milder, Cavitron, etc.) and beads mill.

The dispersion is coated on the surface of the core material by a coater to form a coated layer thereon. Specific examples of the coaters include any typically-used coaters such as rolling fluidized bed using a spray and a method of dipping the core material in the dispersion and drying the solvent.

The coated layer is burned to dry and promote crosslinking reaction. Specific examples of the burners include any typically-used burners such as electric ovens and rotary kilns.

Finally, the agglomerated particles after burned are broken. Specific examples of the breaker include any sifters if particles are sifted to each one peace, such as vibration sifters and ultrasonic vibration sifters.

Further, the sifter not only breaks he agglomerated particles but also removes coarse or foreign particles.

Thus prepared carrier and a toner are mixed at a proper mixing ratio to prepare a developer or a developer for supply. This is just an example of methods of preparing developer of the present invention, and the methods are not limited thereto.

Color toners in the present invention include not only singularly-used color toners but also a black toner in addition to a yellow toner, a magenta toner, a cyan toner, a red toner, a green toner, a blue toner, etc. used for full-color images.

Further, conventional toners regardless of monochrome toners, color toners and full-color toners can be used in the present invention, such as toners prepared by pulverization methods and polymerization methods.

Further, an oilless toner including a release agent can also be used. The release agent tends to transfer to a carrier, but the carrier of the present invention well prevents the release agent from transfer thereto, and produces quality images for long periods. Particularly, the carrier of the present invention is preferably used with an oilless full-color toner including a soft binder resin.

Specific examples of binder resins for use in the toner include known resins, e.g., a monomer of styrene and its derivative such as polystyrene, poly-p-styrene and polyvinyltoluene; a styrene copolymer such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl □-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer; poly(methyl methacrylate), poly(butyl methacrylate), polyvinylchloride, polyvinyl acetate, polyethylene, polyester, polyurethane, epoxy resin, polyvinyl butyral, poly(acrylic acid), rosin, modified rosin, terpene resin, phenolic resin, aliphatic or aromatic hydrocarbon resin, aromatic petroleum resin etc. These can be used alone or in combination.

Specific examples of the binder resins for pressure-fixing include known resins, e.g., polyolefin such as low-molecular weight polyethylene and low-molecular weight polypropylene; olefin copolymer such as ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer and ionomer resin; epoxy resin, polyester, styrene-butadiene copolymer, polyvinylpyrrolidone, methyl vinyl ether-anhydrous maleic acid copolymer, maleic acid-modified phenolic resin, phenol-modified terpene resin etc. These can be used alone or in combination, but the resins are not limited thereto.

The toner for use in the present invention may include a fixing aid besides the binder resin, a colorant and a charge controlling agent. This is why the toner can be used in an oilless system having a fixing system not applying an oil on a fixing roller such that a toner does not adhere thereto. Specific examples of the fixing aid include, but are not limited to, polyolefin such as polyethylene and polypropylene, fatty acid metal salt, fatty acid ester, paraffin wax, amide wax, polyhydric wax, silicone varnish, carnauba wax and ester wax etc.

Specific examples of the colorants include known pigments and dyes capable of forming yellow, magenta, cyan and black toners.

Specific examples of yellow pigment include, but are not limited to, cadmium yellow, mineral fast yellow, nickel titanium yellow, Naples yellow, naphthol yellow S, Hansa yellow G, Hansa yellow 10G benzidine yellow GR, quinoline yellow lake, permanent yellow NCG and tartrazine lake.

Specific examples of orange pigments include, but are not limited to, molybdenum orange, permanent orange GTR, pyrazolone orange, Vulcan orange, indanthrene brilliant orange RK, benzidine orange G and indanthrene brilliant orange GK.

Specific examples of red pigments include, but are not limited to, iron red, cadmium red, permanent red 4R, lithol red, pyrazolone red, watching red calcium salt, lake red D, brilliant carmine 6B, eosin lake, rhodamine lake B, alizarin lake and brilliant carmine 3B.

Specific examples of violet pigments include, but are not limited to, fast violet B and methyl violet lake. Specific examples of blue pigments include, but are not limited to, cobalt blue, alkali blue, Victoria blue lake, phthalocyanine blue, non-metal phthalocyanine blue, phthalocyanine blue-partly chloride, fast sky blue and indanthrene blue BC.

Specific examples of green pigments include, but are not limited to, chromium green, chromium oxide, pigment green B and malachite green lake.

Specific examples of black pigments include, but are not limited to, carbon black, oil furnace black, channel black, lamp black, acetylene black, an azine color such as aniline black, metal salt azo color, metal oxide, complex metal oxide.

These colorants can be used alone or in combination.

The toner may further include a charge controlling agent when necessary. The charge controlling agent is not particularly limited, and nigrosine; an azine dye having an alkyl group having 2 to 16 carbon atoms(see Japanese Examined Patent Publication No. 42-1627); a basic dye such as C.I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040) and C. I. Basic Green 4 (I. C. 42000); and a lake pigment of these basic dyes; a quaternary ammonium salt such as C. I. Solvent Black 8 (C. I. 26150), benzoylmethylhexadecylammonium chloride and decyltrimethyl chloride; a dialkyltin compound such as dibutyl and dioctyl; a dialkyltin borate compound; a guanidine derivative; a polyamine resin such as vinyl polymer having an amino group and condensation polymer having an amino group; a metal complex salt of monoazo dye described in Japanese Examined Patent Publication No. 41-20153, 43-27596, 44-6397 and 45-26478; salicylic acid described in Japanese Examined Patent Publication No. 55-42752 and 59-7385; a metal complex with Zn, Al, Co, Cr, Fe etc. of dialkylsalicylic acid, naphthoic acid and dicarboxylic acid; a sulfonated copper phthalocyanine pigment; organic boron acid slats; fluorine-containing quaternary ammonium salt; calixarene compound etc. can be used. For a color toner besides a black toner, a charge controlling agent impairing the original color should not be used, and white metallic salts of salicylic acid derivatives are preferably used.

The toner optionally includes an external additive. Specific examples thereof include inorganic particulate materials such as silica, titanium oxide, alumina, silicon carbonate, silicon nitride and boron nitride; and particulate resins. These are externally added to mother toner particles to further improve transferability and durability thereof. This is because these external additives cover a release agent deteriorating the transferability and durability of a toner and the surface thereof to decrease contact area thereof. The inorganic particulate materials are preferably hydrophobized, and hydrophobized particulate metal oxides such as silica and titanium oxide are preferably used. The particulate resins such as polymethylmethacrylate and polystyrene fine particles having an average particle diameter of from 0.05 to 1 μm, which are formed by a soap-free emulsifying polymerization method, are preferably used.

Further, a toner including the hydrophobized silica and hydrophobized titanium oxide as external additives, wherein an amount of the hydrophobized silica is larger than that of the hydrophobized titanium oxide, has good charge stability against humidity. A toner including and external additives having a particle diameter larger than that of conventional external additives, such as a silica having a specific surface area of from 20 to 50 m2/g and particulate resins having an average particle diameter of from 1/100 to 1/8 to that of the toner besides the inorganic particulate materials, has good durability.

This is because the external additives having a particle diameter larger than that of the particulate metal oxides prevent the particulate metal oxides from being buried in mother toner particles, although tending to be buried therein while the toner is mixed and stirred with a carrier, and charged in an image developer for development.

A toner internally including the inorganic particulate materials and particulate resins improves pulverizability as well as transferability and durability although improving less than a toner externally including them. When the external and internal additives are used together, the burial of the external additives in mother toner particles can be prevented and the resultant toner stably has good transferability and durability.

Specific examples of hydrophobizers include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxyl silane, vinyltriethoxysilane, vinylmethoxysilane, vinyl-tris (β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminium coupling agents can be used. Besides, as an external additive for the purpose of improving cleanability, lubricants such as a particulate fatty acid metal salt and polyvinylidene fluoride can be used.

The toner can be prepared by known methods such as a pulverization method and a polymerization method. In the pulverization method, as apparatuses for melting and kneading a toner, a batch type two-roll kneading machine, a Bumbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG are preferably used.

The melted and kneaded materials thereby are cooled and pulverized. A hammer mill, rotoplex, etc. crush the cooled materials, and jet stream and mechanical pulverizers pulverize the crushed materials to preferably have an average particle diameter of from 3 to 15 μm. Further, the pulverized materials are classified into the materials having particle diameters of from 5 to 20 μm by a wind-force classifier, etc.

Next, an external additive is preferably added to mother toner particles. The external additive and mother toner particles are mixed and stirred by a mixer such that the external additive covers the surface of the mother toner particles while pulverized. It is essential that the external additives such as inorganic particulate materials and particulate resins are uniformly and firmly fixed to the mother toner particles improve durability of the resultant toner. This is simply an example and the method is not limited thereto.

A conventional developer is explained.

In electrophotography, images are formed by forming a latent electrostatic image by electrostatic charge on an image bearing member formed of photoconductive materials, etc., attaching charged toner particles to the latent electrostatic image to obtain a toner image, transferring the toner image to a recording medium such as paper, and fixing the toner image. In recent years, the technologies regarding photocopiers and printers employing electrophotography have been rapidly diffusing from monochrome field to full color field, thereby expanding the full color market.

In color image forming employing full color electrophotography, four color toners containing toners of three primary colors of yellow, magenta, and cyan and black are laminated for representing all the colors. Therefore, to obtain vivid full color images with excellent color representation, the surface of the fixed toner image is smoothed in some degree to reduce light scattering. Therefore, most of the image gloss of images produced by a typical full color photocopier, etc. ranges from middle gloss to high gloss, e.g., 10 to 50%.

In general, as a method of fixing dry toner images on a recording medium, a contact heating fixing method is commonly used in which a heated roller or belt is pressed against the toner. This method is advantageous in terms of heat efficiency, speed of fixing, imparting gloss and transparency to color toner. However, in this method, since melted toner is peeled off from the surface of a heated fixing member after the melted toner contacts the surface under pressure, part of the toner image may be attached to the surface, resulting in transfer of the attached toner to another recording medium on which another toner image is formed. This is referred to as offset phenomenon.

To prevent the offset phenomenon, in general, a heating fixing member having a surface formed of materials having excellent releasing property such as silicone rubber and fluorine resins is used and in addition releasing oil such as silicone oil is applied to the surface of the heating fixing member. However, this method is extremely effective to prevent offset of toner but requires a device to supply the releasing oil, thereby not shrinking but expanding the size of a fixing device. Therefore, a monochrome toner tends to be used in a method in which the viscous elasticity of the toner in melted state is improved by adjusting the molecular weight distribution of the binder resin to prevent fracturing of the melted toner from inside and furthermore a releasing agent such as wax is contained to apply no (oil free) or few amount of releasing oil to a fixing roller.

Similarly, such an oil-free application has become common for color toner in terms of size reduction of a machine and simplification of the structure thereof. However, as described above, since the surface of a fixed image is required to be smooth to improve the color representation of color toner, toner in melted state having a low viscous elasticity is suitable. Therefore, color toner causes offset phenomenon more easily than monochrome toner, which does not require gloss. That means that it is more difficult to employ a method of applying no (oil free) or few amount of releasing oil to a fixing roller in the case of color toner.

In addition, when a toner containing a releasing agent is used, the attachability of the toner increases, thereby degrading the transfer property of the toner to a transfer medium and resulting in contamination of a triboelectric member such as carriers by the releasing agent, which leads to degradation of the chargeability and durability. Furthermore, in consideration of the environment, toner having a low fixing temperature has been dominantly used to reduce the power consumption. Such toner tends to be inferior to typical toner in terms of preservability in a high temperature and high moisture environment.

In addition, carriers have been used to meet the demand for forming more beautiful images faster. As the speed of image forming increases, a development agent containing carrier and toner particles are subjected to increasing stress, which leads to a short working life of the carrier although carriers have a long working life in general.

Recently, environment and safety have been more aware. Even in the process of producing developers, environmental improvement is required, and various trials of materials and methods of forming films are made. In the process of mixing a developer, the improvement has not been studied because of influencing the environment less than materials and the other processes. However, even in the process of mixing a developer, the environmental improvement is now required as well. Particularly, reduction of $CO_2$ is indispensable.

In the process of mixing a developer, only mixing the developer to be fully charged has been studied. Japanese published unexamined application No. JP-2008-020795-A discloses a method of repeating different two mixing processes, i.e., the second mixing rotation is faster than the first mixing rotation. Japanese published unexamined application No. JP-2001-125317-A discloses a method of preliminarily mixing a part of a carrier and a toner to prepare a preliminary mixture, and mixing the preliminary mixture and the remaining carrier. Further, Japanese published unexamined application No. JP-H07-281482-A discloses a method of mixing a toner having a concentration higher than desired with a carrier until sea and island status disappear, and further mixing them in multistage such that the toner has a desired concentration.

Mixing energy, time and strength need increasing to fully charge the developer by these methods. These methods increase exhaust of $CO_2$ because of being a product $CO_2$ exhaust coefficient, specific energy consumption and an amount of throughput.

Various methods of more uniformly mixing the developer are studied, but these increase exhaust of $CO_2$ and do not reduce exhaust of $CO_2$.

In the present invention, a toner and a carrier are mixed with each other while falling with gravity in a mixing pipe 3. Therefore, the toner and the carrier having passed the mixing pipe 3 are mixed to some extent.

While, the toner and the carrier travel in the falling route, they need no energy to be mixed because of falling with gravity. Thus, mixing energy can be saved to reduce exhaust of $CO_2$.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Experiment Example 1

Examples using Embodiment 1 and Comparative Examples not using Embodiment 1 are described.

Example 1

The following materials were dispersed by a homomixer for 10 min to prepare a solution for forming a covering layer of a carrier.

| | |
|---|---|
| Acrylic resin solution (including solid content of 50% by weight) | 70 |
| Guanamine solution (including solid content of 70% by weight) | 25 |
| Acidic catalyst (including solid content of 70% by weight) | 1 |
| Silicone resin solution (including solid content of 20% by weight) | 340 |
| Amino silane (including solid content of 100% by weight) | 10 |
| Conductive particulate titanium oxide (having a surface treated with ITO, a primary particle diameter of 50 nm and a specific volume resistivity of $1.0 \times 10^2\ \Omega \cdot cm$) | 150 |
| Toluene | 500 |

As a particulate core material used for the carrier, a calcined ferrite powder DC-400M (Mn ferrite from DOWA IP CREATION Co., Ltd.) having an average particle diameter of 35 μm was used. On the surface of the particulate core material, the covering layer forming solution was coated by a SPIRA COTA (from OKADA SEIKO CO., LTD.) at 70° C. inside the SPIRA COTA in such a manner that a layer having a thickness of 0.3 μm is formed thereon.

The thus obtained coated carrier is placed still beside a hollow and bar form conductive wire having a diameter of 6 mm and a high frequency induction current of 200 V and 4 kW is generated in the conductive wire followed by baking at 160° C. for ten minutes.

The hollow wire has a thickness of 1 mm with an inside diameter of 4 mm and heated by the high frequency induction current flowing in the wire. Therefore, cooling water is sent to flow inside the wire to remove this heat. The transmitter for the high frequency induction current is HOTSHOT 5 (6 kW) type, manufactured by Ambrell.

The thus baked carrier is cooled down and crumbled by using a sifter having an opening of 63 μm to obtain Carrier 1 having an amount of charge of 39 (−μc/g) and a volume specific resistance of 14.1 (Log(Ω·cm).

A toner is prepared by using the following materials.

| | |
|---|---|
| Binder resin: polyester resin | 100 |
| Releasing agent: carnauba wax | 5 |
| Charge control agent | 1 |
| (E-84, manufactured by Orient Chemical Industries Co., Ltd.): | |
| Colorant: C.I.P.Y. 180 | 8 |

The coloring agent, the binder resin, and pure water are mixed with a ratio of 1:1:0.5 and kneaded by a two roll. The resultant is mixed and kneaded at 70° C. first and then the temperature of the rolls is raised to 120° C. to evaporate the water to prepare a master batch. The materials are weighed to be the same as the recipe specified above by using the thus obtained master batch and mixed by a Henschel Mixer followed by melting, mixing, and kneading by a two roll at 120° C. for 40 minutes. Subsequent to cooling down, the resultant is coarsely pulverized by a hammer mill and finely pulverized by an air jet pulverizer followed by classifying the finely pulverized powder to obtain mother toner particles having a weight average particle diameter of 5 μm.

Thereafter, one part of silica having a hydrophobized surface and one part of titanium oxide having a hydrophobized surface are added to 100 parts of the mother toner followed by mixing by a Henschel mixer to obtain Toner 1 (yellow toner).

Figure 8:
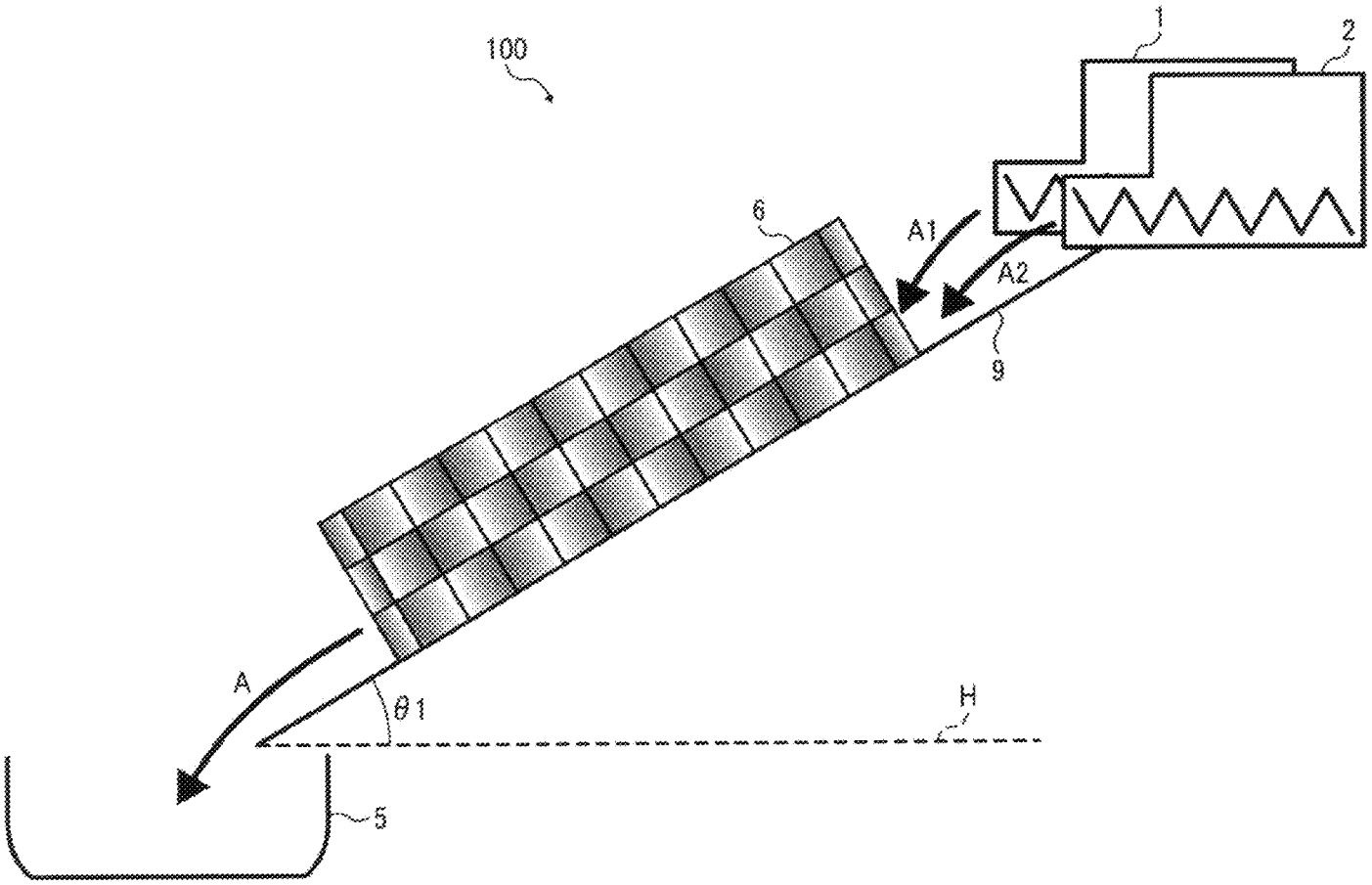
FIG. 8 is a schematic view illustrating a gravity fall mixer in Example 1.

The Carrier 1 and the Toner 1 were mixed with each other in a gravity fall mixer 100 in FIG. 8.

The gravity fall mixer 100 in FIG. 8 includes a carrier feeder 1, a toner feeder 2, a mixing tilted plate 9 and a developer container 5. On the upper surface of the mixing tilted plate 9, a plurally-divided direction controlling member 6 is located.

The mixing tilted plate 9 has an angle θ1 of 30° relative to a horizontal surface H, and the plurally-divided direction controlling member 6 includes plural 1 mm wide direction controlling plates.

At an upper end of the mixing tilted plate 9 the plurally-divided direction controlling member 6 is located on, the carrier feeder 1 and the toner feeder 2 formed of ACCURATE FEEDER from KUMA engineering Co., Ltd. are located. The carrier feeder 1 and the toner feeder 2 fed Carrier1 and Toner 1 at a mixing ratio (toner/carrier) of 7/93 by weight. The carrier and the toner fall along the slope so as to all pass the plurally-divided direction controlling member 6 on the mixing tilted plate 9 to be mixed by the kinetic energy. Thus, Developer 1 having a toner concentration of 7% by weight was prepared.

Example 2

The procedure for preparation of Developer 1 in Example 1 was repeated except for replacing the plurally-divided direction controlling member 6 with a sifter-type direction controlling member 7 having an opening of 412 μm.

Example 3

The procedure for preparation of Developer 1 in Example 1 was repeated except for replacing the gravity fall mixer 100 in FIG. 8 with the gravity fall mixer 100 in FIG. 1 to prepare Developer 3.

The ribbon-type direction control member 4 of the gravity fall mixer 100 is a one segment belt-shaped plate twisted at 180°. Twelve segments were overlapped such that twisting directions alternate from side to side. The segments are overlapped to have a shift of 90°, respectively. Every time the above segment transfers to the lower segment, particles are divided into half. As FIG. 4 shows, one stage includes 2 segments of the ribbon-type direction control member 4, and 12 stages are located.

Example 4

The procedure for preparation of Developer 3 in Example 3 was repeated except for replacing the ribbon-type direction control member 4 in the gravity fall mixer 100 in FIG. 1 with the plurally-divided direction controlling member 6 to prepare Developer 4.

Example 5

The procedure for preparation of Developer 3 in Example 3 was repeated except for replacing the ribbon-type direction control member 4 in the gravity fall mixer 100 in FIG. 1 with the reducer-type direction control member 8 having ⅕ cross-sectional area to prepare Developer 5.

Example 6

The procedure for preparation of Developer 3 in Example 3 was repeated except for replacing the ribbon-type direction control member 4 in the gravity fall mixer 100 in FIG. 1 with the overlapped 50 sifter-type direction control member 7 having an opening of 288 μm to prepare Developer 6.

Example 7

The procedure for preparation of Developer 3 in Example 3 was repeated except for replacing the ribbon-type direction control member 4 in the gravity fall mixer 100 in FIG. 1 with the following direction control member to prepare Developer 7.

One sifter-type direction control member 7 having an opening of 288 μm was combined with 2 segments of the ribbon-type direction control member 4 in FIG. 4 to form one stage, and 12 stages were overlapped.

Example 8

The procedure for preparation of Developer 3 in Example 3 was repeated except for replacing the ribbon-type direction control member 4 in the gravity fall mixer 100 in FIG. 1 with the following direction control member to prepare Developer 8.

One sifter-type direction control member 7 having an opening of 288 μm and one reducer-type direction control member 8 having ⅕ cross-sectional area were combined with 2 segments of the ribbon-type direction control member 4 in FIG. 4 to form one stage, and 12 stages were overlapped.

Example 9

The procedure for preparation of Developer 8 in Example 8 was repeated except for replacing the ribbon-type direction control member 4 in the gravity fall mixer 100 with the plurally-divided direction controlling member 6 to prepare Developer 9.

Example 10

The procedure for preparation of Developer 6 in Example 6 was repeated except for changing the mixing ratio of the toner to the carrier into 9/1 by weight to prepare Developer 10. This is used for a developer for supply.

Comparative Example 1

The procedure for preparation of Developer 1 in Example 1 was repeated except for replacing the gravity fall mixer 100 with a V-type mixer V-5 from KOTOBUKI INDUSTRIES CO., LTD., having an electric power of 100 kWh. The mixing process was performed at 30 rpm for 17 min to prepare Devloper 11.

Comparative Example 2

The procedure for preparation of Developer 1 in Example 1 was repeated except for replacing the gravity fall mixer 100 with Labomixer LV-1 from Hosokawa Micron Corp., having an electric power of 100 kWh. The mixing process was performed at 180 rpm for 32 min to prepare Devloper 12.

Comparative Example 3

The procedure for preparation of Developer 1 in Example 1 was repeated except for replacing the gravity fall mixer 100 with Tubular Mixer T2C from Shinmaru Enterprises Corp., having an electric power of 180 kWh. The mixing process was performed at 32 rpm for 7 min to prepare Devloper 13.

Variation of toner concentration and $CO_2$ exhaust of Developers 1 to 13 were evalauated. The results are shown in Table 1.

TABLE 1

| | Variation of toner Concentration | | $CO_2$ exhaust |
|---|---|---|---|
| | Standard deviation | Judgment | [kg($CO_2$)/kWh] |
| Example 1 | 0.22 | Good | 0.0 |
| Example 2 | 0.21 | Good | 0.0 |
| Example 3 | 0.21 | Good | 0.0 |
| Example 4 | 0.22 | Good | 0.0 |
| Example 5 | 0.23 | Good | 0.0 |
| Example 6 | 0.20 | Excellent | 0.0 |
| Example 7 | 0.19 | Excellent | 0.0 |
| Example 8 | 0.17 | Excellent | 0.0 |
| Example 9 | 0.18 | Excellent | 0.0 |
| Example 10 | 0.20 | Excellent | 0.0 |
| Comparative Example 1 | 0.21 | Good | 10.7 |
| Comparative Example 2 | 0.23 | Good | 15.8 |
| Comparative Example 3 | 0.20 | Excellent | 7.9 |

[Method of Evaluating Variation of Toner Concentration]

Ten-point sampling was evenly and randomly performed on the developer and the toner concentration was measured by a typical blow-off method using TB-200 from Toshiba Chemical Corp. A standard deviation was calculated from the ten points and ranked.

Excellent: 0.20 or less

Good: greater than 0.20 and less than 0.24

Poor: 0.24 or more (unusable)

[$CO_2$ Exhaust Evaluation Method]

$CO_2$ exhaust is calculated from electric power consumption in mixing, and the electric power consumption is multiplied by a standard $CO_2$ corresponding value. The standard $CO_2$ corresponding value was 0.378 kg($CO_2$)/kWh. The electric power is mutiplied by a mixing time to calculate the electric power consumption.

$CO_2$ exhaust is only in mixing. Electric power consumtion when feeding the carrier and the toner is not considered. In Comparative Examples, electric power is not consumed because the carrier and the toner are not fed when mixing. However, the carrier and the toner were actually weighed before mixed and electric power was consumed. This is the same as each Example in terms of being out of $CO_2$ exhaust, and it can be said they are impartially evaluated.

As Table 1 shows, the toner concentrations of Examples 1 to 10 are same or better than those of Comparative Examples 1 to 3, and $CO_2$ exhausts thereof are obviously prevented.

Embodiment 2

Figure 9:
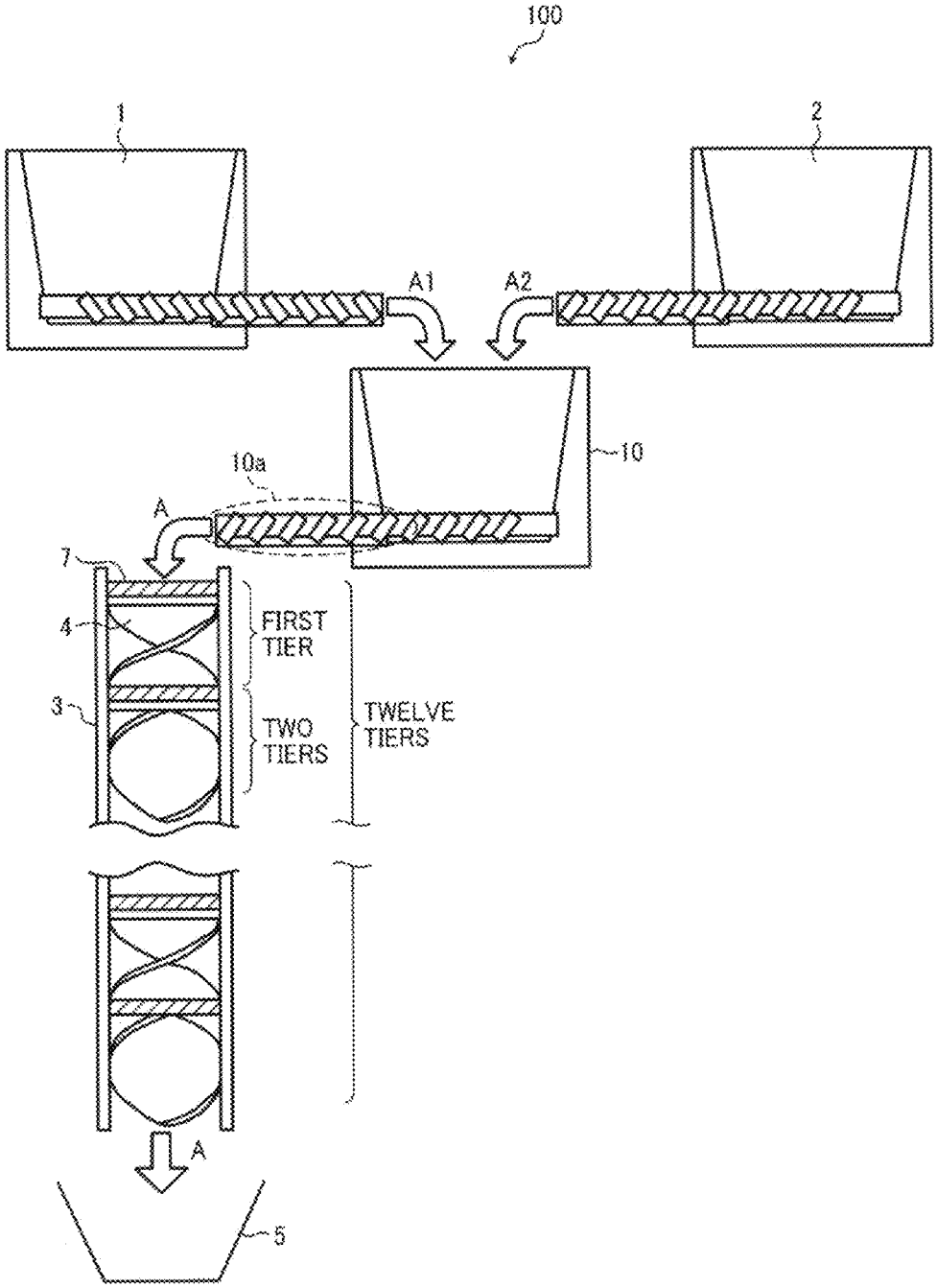
FIG. 9 is a schematic view illustrating a gravity fall mixer of embodiment 2.

FIG. 9 is a schematic view illustrating a gravity fall mixer 100 of embodiment 2.

As FIG. 9 shows, the gravity fall mixer 100 of embodiment 2 includes a carrier feeder 1, a toner feeder 2, a mixing pipe 3, a developer container 5, and further a shearing mixer 10. The mixing pipe 3 includes a ribbon-type direction control member 4 and a sifter-type direction control member 7.

The gravity fall mixer 100 in FIG. 9 includes two ribbon-type direction control members 4 overlapped at a shift of 90°, sandwiching one sifter-type direction control member 7.

Conventional developer mixers include rotational stirring container types such as horizontal cylinder types, inclined cylinder types, V types, double cone types, cubic type, S types, continuous V-type mixers, etc. Fixed container types include ribbon types, screw types, rod or pin types, pluriaxial paddle types, cone types, screw high-speed fluid types, rotational disc types, their complex mixers, etc.

When a carrier and a toner are mixed at a fixed mixing rate, mixing energy and time vary charge quantity of the developer. Typically, in order to make a developer have high charge quantity, mixing time needs to be long. Therefore, power consumption increases, which is a disadvantage for environment protection.

In order to improve this, in Embodiment 1, a developer is mixed in the gravity fall mixer 100 using gravity fall. A carrier and a toner are mixed while falling by gravitational force. Therefore, power is not consumed basically, which is very advantageous for environment protection.

However, it is difficult for a developer mixed by gravity fall to have sufficient initial charge quantity. Such a mixer as has no driver needs to be large to make a developer have sufficient charge quantity.

This is because potential energy is a main energy for mixing, and a toner and a carrier need to fall from higher position to be mixed stronger. Therefore, the gravity fall mixer needs to be large such that they fall from higher position.

When a developer insufficiently charged is used as an initial developer, the toner occasionally releases from the carrier borne on the surface of a developing roller of the image developer 13 when the developer is fed thereon. When the toner releases from the carrier, the toner adheres to a non-image area of the photoreceptor 11, resulting in background fouling.

Further, when a developer is not sufficiently charged, an absolute value of the charge quantity is low and a part having lower charge distribution is reverse charged. The toner is developed on non-image area of the photoreceptor 11, resulting in background fouling.

In Embodiment 1, the gravity fall mixer having no driver produces a developer incapable of sufficiently maintain charge, which possibly contaminates background of images with the toner.

In Embodiment 2, the gravity fall mixer 100 includes a shearing mixer 10 applying a shearing force. This mixes well without poor initial charge and produces a developer producing images having no background fouling.

The gravity fall mixer 100 in FIG. 9 includes a combination of two mixings of gravity fall and application of shearing force in the mixing pipe 3.

The developer is charged only when the carriers and the toners contact each other or objects located in a falling route, and not sufficiently charged in some cases. The gravity fall mixer 100 in Embodiment 2 applies a shearing force to promote charging the developer. The shearing mixer 10 applies a shearing force to a powder in a shear mixing transfer route 10*a* formed of a tubular component in which a screw member is located.

Embodiment 2 is a method of mixing a carrier and a toner using a gravitational force. The carrier and the toner are fed in a mixing part and mix with each other while falling by gravitational force.

Even in Embodiment 2, any one of the four types of direction controlling members or combinations thereof are preferably located in the gravity fall route. The direction controlling members divide a bulk of the powder falling, convert directions of the powder and reducing speed thereof to complicate movement thereof and promote mixing.

Figure 10:
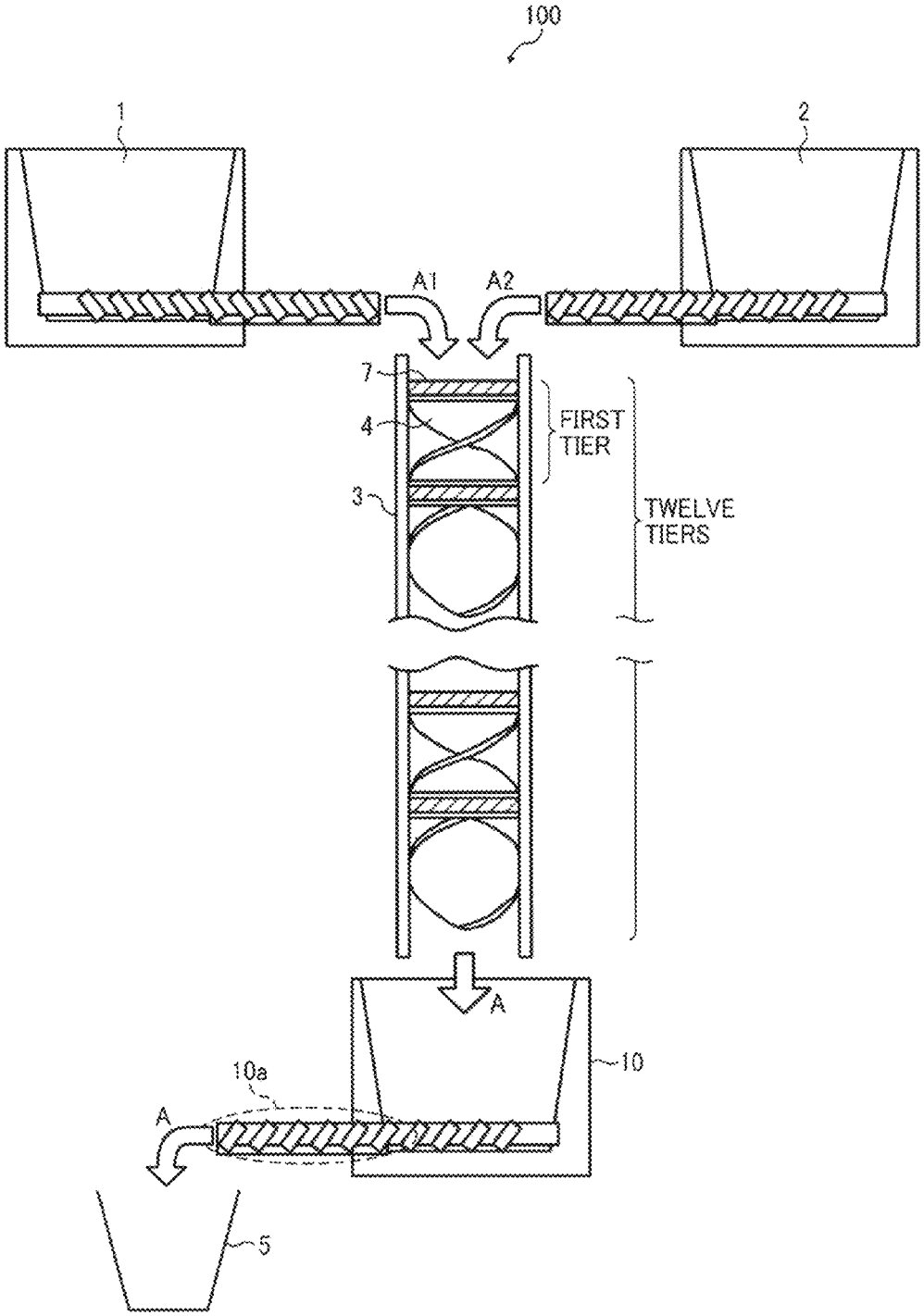
FIG. 10 is a schematic view illustrating another gravity fall mixer of embodiment 2.

FIG. 10 is a schematic view illustrating a gravity fall mixer 100 applying a shearing force after mixing. The gravity fall mixer 100 in FIG. 9 applies a shearing force before mixing. However, a shearing force is preferably applied before mixing.

This is because of the following reasons.

In the gravity fall mixer 100 in FIG. 9, the carrier feeder 1 and the toner feeder 2 directly feed particles to the shearing mixer 10, and a shearing force is applied to carriers and toners adjacent to each other. The carriers and the toners scrape each other, respectively.

The gravity fall mixer 100 in FIG. 10 applies a shearing force after mixing to replace a position of the carrier with a position of the toner. The carrier and the toner are located adjacent to each other more than when the carrier feeder 1 and the toner feeder 2 directly feed particles to the shearing mixer 10. Typically, a frictional charge is made by friction between materials having electrical properties different from each other. Friction due to application of shearing force between the relocated carrier and toner promote charging them.

The gravity fall mixer 100 in FIG. 10 includes two ribbon-type direction control members 4 overlapped at a shift of 90°, sandwiching one sifter-type direction control member 7.

In the gravity fall mixers 100 in FIGS. 9 and 10, mixing by shearing force application is made when the carrier and the toner are frictionized between an inner wall of the tubular member and the screw member. In Embodiment 2, the carrier and the toner are extruded by a transfer member. Not only among the carriers and toners, opportunities of applying shearing forces increase, i.e., among the carrier, toner and transfer member or the inner walls. Therefore, the developer is efficiently charged.

In Embodiment 2, a screw member is used as a transfer member, and transfer members having the other shapes such as sticks and coils can also be used. The transfer member preferably has a pattern-grooved surface.

The inner wall is an inside of the tubular member and has the shape of a cylinder or a cone, and preferably has a pattern-grooved surface.

These are examples after all, and the shapes and materials can be selected according to properties and mixing strength of a powder to be mixed.

Figure 11A:
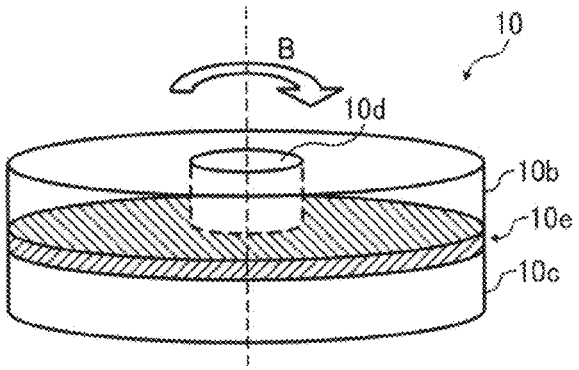
FIG. 11A is a perspective view and FIG. 11B is a side cross-sectional view of another embodiment of shearing mixer.
Figure 11B:
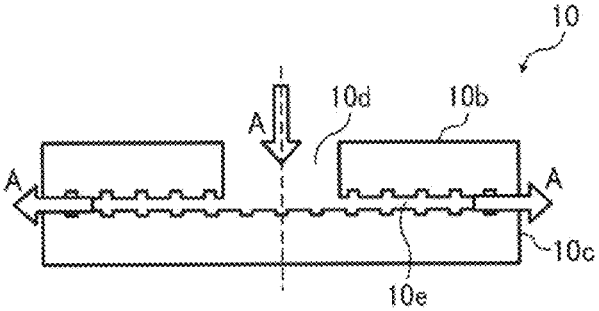

FIG. 11A is a perspective view and FIG. 11B is a side cross-sectional view of another embodiment of shearing mixer.

The shearing mixer 10 in FIGS. 11A and 11B is formed of two discs, i.e., an upper disc member 10*b* and a lower disc member 10*c*. A gap 10*e* is formed between the upper disc member 10*b* and the lower disc member 10*c*, and a slot 10*d* connected to the gap 10*e* is formed at the center of the upper disc member 10*b*.

In the shearing mixer 10 in FIGS. 11A and 11B, as indicated by an arrow B, the upper disc member 10*b* rotates relative to the lower disc member 10*c*.

A developer formed of a carrier and a toner placed from the slot 10*d* is applied with a shearing force by the rotating upper disc member 10*b* and the lower disc member 10*c* when passing the gap 10*e* therebetween. The two discs can broad an area where the sharing force is applied, which efficiently charges the developer.

One or both of the surfaces of the disc members facing each other rotate. The surfaces facing each other are preferably pattern-grooved to apply larger shearing force to the carrier and the toner.

The carrier and the toner need to constantly continue moving to be continuosly applied with shearing force. Therefore, a part forming the gap 10*e* preferably has a gentle slope concentrically from the center as a peak like a grindstone.

These are examples after all, and the number of the disc members, shapes and materials can be selected according to properties and mixing strength of a powder to be mixed.

Figure 12:
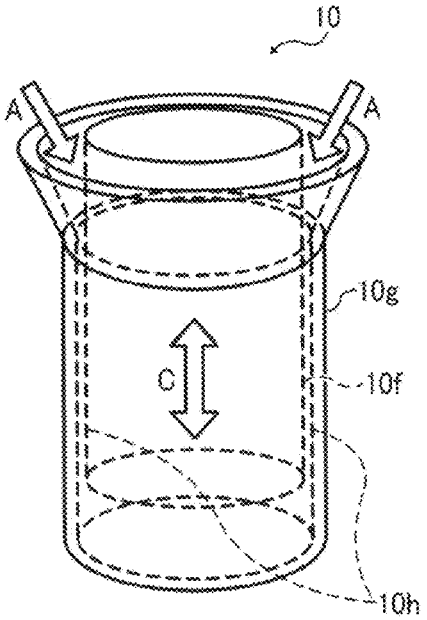
FIG. 12 is a schematic view illustrating a further embodiment of shearing mixer.

FIG. 12 is a schematic view illustrating a further embodiment of shearing mixer 10.

The shearing mixer 10 in FIG. 12 is formed of a shearing force application tube 10*g* and a shearing force application cylinder 10*f*. A gap is formed between an inner wall of the shearing force application tube 10*g* and the shearing force application cylinder 10*f*, which is a shearing force application part 10*h*.

The shearing force application cylinder 10*f* is located at a falling route of a developer in the shearing force application tube 10*g*, and oscillates up and down as indicated by an arrow C.

In the shearing mixer 10 in FIG. 12, a developer formed of a carrier and a toner is placed from the head of the shearing force application tube 10*g* and passes the shearing force application part 10*h*. The toner and the carrier are mixed by shearing force generated by friction between the driving shearing force application cylinder 10*f* and the shearing force application tube 10*g* when passing shearing force application part 10*h*. Thus, the developer is frictionally charged.

The driving shearing force application cylinder 10*f* has the shape of a stick or a cone and preferably has a pattern-grooved surface to efficiently apply shearing force. The driving shearing force application cylinder 10*f* preferably drives up and down or rotates to broad an area where the sharing force is applied The shearing force application tube 10*g* has the shape of a cylinder or a cone and preferably has a pattern-grooved surface to efficiently apply shearing force.

These are examples after all, and shapes and materials can be selected according to properties and mixing strength of a powder to be mixed.

The toner and the carrier used in Embodiment 1 can also be used in Embodiment 2, but are not limited thereto.

Experiment Example 2

Examples using Embodiment 2 and Comparative Examples not using Embodiment 2 are described.

Example 11

The procedure for preparation of Toner 1 was repeated except for replacing 8 parts of Y. 180 with 10 parts of carbon black #44 from Mitsubishi Chemical Corp. to prepare Toner 2.

The Carrier 1 and the Toner 2 were mixed with each other in a gravity fall mixer 100 in FIG. 9.

One sifter-type direction control member 7 having an opening of 288 μm was combined with 1 segment of the ribbon-type direction control member 4 to form one stage, and 12 stages were overlapped in a mixing pipe 3 of the gravity fall mixer 100.

Above the mixing pipe 3, a shearing mixer 10 formed of ACCURATE FEEDER from KUMA engineering Co., Ltd. and a shear mixing transfer route 10*a* to apply shearing force to a carrier and a toner is located. The shear mixing transfer route 10*a* is a cylindrical tube having an inner diameter of 20 mm the carrier and the toner pass, in which a screw member is located. A distance from on outer circumference of a blade of the screw member to an inner circumferential surface of the shear mixing transfer route 10*a* is 1 mm, and the screw member has a rotational number so as to exhaust 2.5 g/sec.

Above the shearing mixer 10, a carrier feeder 1 and a toner feeder 2 formed of ACCURATE FEEDER from KUMA engineering Co., Ltd. are located. The carrier feeder 1 and the toner feeder 2 fed Carrier1 and Toner 2 at a mixing ratio (toner/carrier) of 7/93 by weight. The carrier and the toner fall so as to all pass the 12 stages of the combined sifter-type direction control member 7 and ribbon-type direction control member 4 to be mixed by the kinetic energy. Thus, Developer 14 having a toner concentration of 7% by weight was prepared.

The ribbon-type direction control member 4 of the gravity fall mixer 100 is a one segment belt-shaped plate twisted at 180°. Twelve segments were overlapped such that twisting directions alternate from side to side. The gravity fall mixer 100 includes two ribbon-type direction control members 4 overlapped at a shift of 90°, sandwiching one sifter-type direction control member 7. Every time the carrier and the toner transfer from the upper ribbon-type direction control member 4 to the lower ribbon-type direction control member 4, sandwiching the sifter-type direction control member 7, particles are divided into half. Thus, movement of particles is complicated to promote mixing.

Example 12

The procedure for preparation of Developer 14 in Example 11 was repeated except for replacing the gravity fall mixer 100 with the gravity fall mixer 100 in FIG. 10 to prepare Developer 15.

Example 13

The procedure for preparation of Developer 15 in Example 12 was repeated except for locating a cone-shaped outlet of the carrier and the toner, having an inner diameter of 5 mm at the end of the shear mixing transfer route 10*a* to prepare Developer 16.

Example 14

The procedure for preparation of Developer 15 in Example 12 was repeated except for replacing the shearing mixer 10 with the sharing mixer 10 in FIG. 11, which has the shape of a grindstone formed of a two flat plates and a rotational axis at the center rotating one of the flat plates to prepare Developer 17. The two flat plates respectively have pattern-grooved surfaces facing each other.

Example 15

The procedure for preparation of Developer 17 in Example 14 was repeated except for replacing the shearing mixer 10 with the shearing mixer 10 in which both of the two flat plates rotate, and controlling the rotational number thereof to so as to exhaust a mixture of the carrier and the toner at 2.5 g/sec to prepare Developer 18.

Example 16

The procedure for preparation of Developer 15 in Example 12 was repeated except for replacing the shearing mixer 10 with the sharing mixer 10 in FIG. 12 to prepare Developer 19. A gap between an inner wall of the shearing force application tube 10*g* and the shearing force application cylinder 10*f* moving up and down therein the was 0.5 mm. The moving speed of the shearing force application cylinder 10*f* was controlled to exhaust a mixture of the carrier and the toner at 2.5 g/sec. The shearing force application tube 10*g* and the shearing force application cylinder 10*f* respectively have coarse surfaces forming the gap (shearing force application part 10*h*) subjected to blast finishing.

Example 17

The procedure for preparation of Developer 17 in Example 16 was repeated except for replacing the shearing force application cylinder 10*f* with the shearing force application cylinder 10*f* rotating to prepare Developer 20.

Example 18

The procedure for preparation of Developer 15 in Example 12 was repeated except for changing the mixing ratio of the toner to the carrier into 9/1 by weight to prepare Developer 21. This is used for a developer for supply.

Comparative Example 4

The procedure for preparation of Developer 14 in Example 11 was repeated except for replacing the gravity fall mixer 100 with the gravity fall mixer without the shearing mixer 10 to prepare Developer 22.

Comparative Example 5

The procedure for preparation of Developer 16 in Example 13 was repeated except for not having used the gravity fall mixer 100 to prepare Developer 23.

Comparative Example 6

The procedure for preparation of Developer 18 in Example 15 was repeated except for not having used the gravity fall mixer 100 to prepare Developer 24.

Comparative Example 7

The procedure for preparation of Developer 20 in Example 17 was repeated except for not having used the gravity fall mixer 100 to prepare Developer 25.

Variation of toner concentration, charge quantity and background fouling of Developers 14 to 25 were evaluated. The results are shown in Table 2.

TABLE 2

| | Variation of toner concentration | | Charge Quantity Q/M | | ID Measured | |
|---|---|---|---|---|---|---|
| | σ | Judgment | [−μC/g] | Judgment | value | Judgment |
| Example 11 | 0.320 | Good | 30 | Good | 0.035 | Fair |
| Example 12 | 0.190 | Good | 40 | Excellent | 0.012 | Good |
| Example 13 | 0.160 | Excellent | 48 | Excellent | 0.004 | Excellent |
| Example 14 | 0.160 | Excellent | 48 | Excellent | 0.004 | Excellent |
| Example 15 | 0.110 | Excellent | 49 | Excellent | 0.004 | Excellent |
| Example 16 | 0.190 | Good | 42 | Excellent | 0.005 | Excellent |
| Example 17 | 0.160 | Excellent | 42 | Excellent | 0.005 | Excellent |
| Example 18 | 0.190 | Good | 40 | Excellent | 0.012 | Good |
| Comparative Example 4 | 0.440 | Fair | 19 | Poor | 0.100 | Poor |
| Comparative Example 5 | 2.870 | Poor | 23 | Fair | 0.100 | Poor |
| Comparative Example 6 | 2.760 | Poor | 24 | Fair | 0.100 | Poor |
| Comparative Example 7 | 2.910 | Poor | 21 | Fair | 0.100 | Poor |

[Method of Evaluating Variation of Toner Concentration]

Ten-point sampling was evenly and randomly performed on the developer and the toner concentration was measured by a typical blow-off method using TB-200 from Toshiba Chemical Corp. A standard deviation σ was calculated from the ten points and ranked.

Excellent (Usable): $\sigma<0.18$

Good (Usable): $0.18\leq\sigma<0.40$

Fiar (Usable): $0.40\leq\sigma<1.00$

Poor (Unusable): $1.00\leq\sigma$

[Method of Evaluating Charge Quantity]

A specific amount of the developer was placed in a cage which is an electroconductive container having metallic meshes at both ends. From a nozzle, a compressed gas was sprayed to blow only the toner out of the cage. A charge Q of the carrier remaining in the cage was measured by a voltmeter. Further, the weight of the toner M was measured, and Q/M [−μc/g] was determined as a charge quantity per weight and ranked.

Excellent (Usable): $40\leq Q/M$

Good (Usable): $30\leq Q/M<40$

Fair (Usable): $20\leq Q/M<30$

Poor (Unusable): $Q/M\leq 20$

[Method of Evaluating Background Fouling]

The developer was set in a marketed and modified full-color printer imagio MP C5000 from Ricoh Company, Ltd to evaluate background fouling.

Specifically, the background potential was fixed at 150 V and development of a solid A3 image was started right after the developer was set. The development was forcibly stopped when the image was developed on a photoreceptor. Next, a transparent tape was attached to the part where the image was developed on the photoreceptor to transfer toner particles on the photoreceptor onto the transparent tape.

Then, the transparent tape was attached onto a brand-new white paper and separated into 10 areas. The image density of the center of each of the areas was measured and averaged. The image density was measured by a spectrodensitometer X-Rite938 from X-Rite, Inc. The image density on the white paper was deduced from the image density on the transparent tape (only the density of the background fouling) to rank.

Excellent (Usable): $ID<0.01$

Good (Usable): $0.01\leq ID<0.03$

Fair (Usable): $0.03\leq ID<0.05$

Poor (Unusable): $0.05\leq ID$

The developers in Examples 11 to 18 obviously improve in toner concentration, charge quantity and background fouling, compared with Comparative Examples 4 to 7.

Embodiment 3

Figure 13:
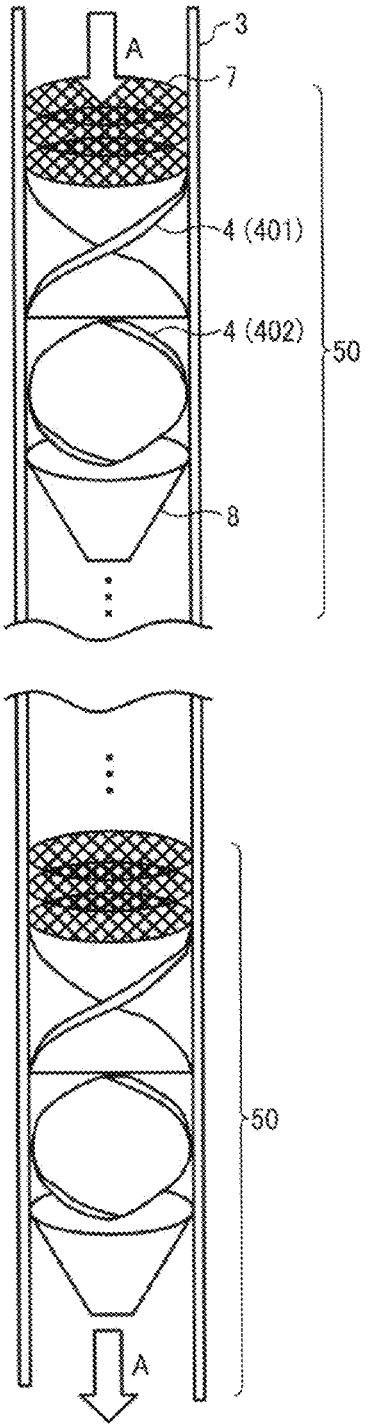
FIG. 13 is a schematic view illustrating a fall route of a gravity fall mixer of embodiment 3.

FIG. 13 is a schematic view illustrating a fall route of a gravity fall mixer of embodiment 3.

Besides the direction controller, the gravity fall mixer 100 has the same configuration as that of the gravity fall mixer 100 in FIG. 1.

The gravity fall mixer 100 is a combination of the sifter-type direction control member 7 and the reducer-type direction control member 8 having a squeezing shape. The reducer-type direction control member 8 is located after the sifter-type direction control member 7.

As mentioned in Embodiment 2, the gravity fall mixer 100 in Embodiment 1 is environmentally advantageous.

However, the gravity fall mixer having no driver in Embodiment 1 produces a developer incapable of sufficiently maintain charge, which possibly contaminates background of images with the toner.

The gravity fall mixer 100 in Embodiment 3 mixes a toner and a carrier well to prepare a developer without being poorly charged initially not to produce images having background fouling. This is because of the following reason.

After the sifter-type direction control member 7 divides aggregates of the carrier and the toner to increase surface area, the reducer-type direction control member 8 having a squeezing shape gathers them. This increases frequency of friction therebetween, efficiently charges them, and promotes mixing them.

The sifter-type direction control member 7 in FIG. 6 can be used, but is not limited thereto. The sifter-type direction control member 7 is capable of controlling mixing intensity with openings, intervals, numbers, angles, etc. of the sifter. Plural sifters having the same opening or different openings can be combined, but are not limited thereto.

The sifter-type direction control member 7 can be formed of negatively-chargeable TEFLON®, polypropylene and polyester; and positively-chargeable nylon and silk. These largely improve mixing efficiency and impart large charge quantity, but are not limited thereto.

In addition to the sifter-type direction control member 7 and the reducer-type direction control member 8, the ribbon-type direction control member 4 is preferably added thereto. This is because of the following reason.

The ribbon-type direction control member 4 divides a bulk of the carrier and the toner falling, converting directions and reducing falling speed thereof. This complicates movement of the carrier and the toner to increase frequency of friction therebetween, efficiently charges them, and promotes mixing them.

The ribbon-type direction control member 4 in FIG. 4 can be used, but is not limited thereto.

As FIG. 13 shows, the ribbon-type direction control member 4 is preferably located between the sifter-type direction control member 7 and the reducer-type direction control member 8. This is because of the following reason.

The ribbon-type direction control member 4 located below the sifter-type direction control member 7 complicates movement of each of the carriers and the toners. Further, when the carrier and the toner pass the ribbon-type direction control member 4, they are relocated and frequency of friction therebetween increases to efficiently charge them and promote mixing them.

In FIG. 13, a direction control unit 50 is formed, in which the sifter-type direction control member 7, the ribbon-type direction control member 4 and the reducer-type direction control member 8 are located in this order.

A combination of the direction control members like the direction control unit 50 is preferably repeated more than once.

A combination of the mesh-shaped direction control member and the squeezing-shaped direction control member, or a combination of the mesh-shaped direction control member, the twist-shaped direction control member and the squeezing-shaped direction control member is located more than once. Frequency of friction between the carrier and the toner which were not fully mixed by one combination increases to efficiently charge them and promote mixing them.

An unillustrated oscillator oscillating the mixing pipe 3 may be located. This can make the carrier and the toner adhering to the direction control members (7. 4 and 8 in FIG. 13) fall by oscillation to constantly feed the new carrier and the new toner to the direction control members. Thus, the direction control members efficiently work to efficiently charge the carrier and the toner and promote mixing them.

As the oscillator, a ball rotating at high speed with compressed air is placed in the direction control member to oscillate. An oscillator may contact the mixing pipe 3 from outside to oscillate. The oscillator is not limited thereto.

Experiment Example 3

Examples using Embodiment 3 and Comparative Examples not using Embodiment 3 are described.

Example 19

The Carrier 1 and the Toner 2 were mixed with each other in the following gravity fall mixer.

The gravity fall mixer includes three sifter-type direction control members 7 having an opening of 288 μm vertically overlapped at intervals of 5 mm and the reducer-type direction control member 8. Above the direction control members, a carrier feeder 1 and a toner feeder 2 formed of ACCURATE FEEDER from KUMA engineering Co., Ltd. are located. The carrier feeder 1 and the toner feeder 2 fed Carrier1 and Toner 2 at a mixing ratio (toner/carrier) of 7/93 by weight. The carrier and the toner fall so as to all pass the direction control members to be mixed by the kinetic energy. Thus, Developer 26 having a toner concentration of 7% by weight was prepared.

Example 20

The procedure for preparation of Developer 26 in Example 19 was repeated except for locating the ribbon-type direction control member 4 below the reducer-type direction control member 8 to prepare Developer 27.

Example 21

The procedure for preparation of Developer 26 in Example 19 was repeated except for locating the ribbon-type direction control member 4 below the sifter-type direction control members 7 to prepare Developer 28.

Example 22

The procedure for preparation of Developer 26 in Example 19 was repeated except for locating the ribbon-type direction control member 4 between the sifter-type direction control member 7 and the reducer-type direction control member 8 to prepare Developer 29.

Example 23

The procedure for preparation of Developer 29 in Example 22 was repeated except for locating 10 units of a combination of the sifter-type direction control member 7, the reducer-type direction control member 8 and the ribbon-type direction control member 4 (the direction control unit 50 in FIG. 13) to prepare Developer 30.

Example 24

The procedure for preparation of Developer 29 in Example 22 was repeated except for contacting a V-type vibrator from SINFONIA TECHNOLOGY CO., LTD to the direction control member from outside to prepare Developer 31.

Example 25

The procedure for preparation of Developer 31 in Example 24 was repeated except for locating the direction control members in the mixing pipe 3 to prepare Developer 32.

Example 26

The procedure for preparation of Developer 32 in Example 25 was repeated except for changing the mixing ratio of the toner to the carrier into 9/1 by weight to prepare Developer 33. This is used for a developer for supply.

Comparative Example 8

The procedure for preparation of Developer 26 in Example 19 was repeated except for interchanging the sifter-type direction control member 7 and the reducer-type direction control member 8 to prepare Developer 34.

Comparative Example 9

The procedure for preparation of Developer 34 in Comparative Example 8 was repeated except for locating the ribbon-type direction control member 4 between the reducer-type direction control member 8 and the sifter-type direction control member 7 to prepare Developer 35. Namely, the reducer-type direction control member 8, the ribbon-type direction control member 4 and the sifter-type direction control member 7 were located in this order.

Comparative Example 10

The procedure for preparation of Developer 35 in Comparative Example 9 was repeated except for replacing the gravity fall mixer 100 with Tubular Mixer T2C from Shinmaru Enterprises Corp., having an electric power of 180 kWh. The mixing process was performed at 32 rpm for 7 min to prepare Developer 36.

Variation of toner concentration, charge quantity and background fouling of Developers 26 to 36 were evaluated. The power efficiency (specific energy consumption) in each of the mixing processes to prepare them was evaluated as well. The results are shown in Table 3.

TABLE 3

| | VTC | TC | CQ Q/M | | ID | | SEC MV | |
|---|---|---|---|---|---|---|---|---|
| | σ | J | [−μC/g] | J | MV | J | [kWh/kg] | J |
| Example 19 | 4.58 | F | 10 | F | 0.048 | F | 0.0000 | G |
| Example 20 | 4.04 | F | 10 | F | 0.046 | F | 0.0000 | G |
| Example 21 | 4.16 | F | 10 | F | 0.046 | F | 0.0000 | G |
| Example 22 | 2.52 | F | 14 | F | 0.040 | F | 0.0000 | G |
| Example 23 | 0.76 | G | 28 | G | 0.028 | G | 0.0000 | G |
| Example 24 | 0.07 | E | 32 | E | 0.005 | E | 0.0022 | F |
| Example 25 | 0.05 | E | 34 | E | 0.005 | E | 0.0022 | F |
| Example 26 | 0.05 | E | 34 | E | 0.005 | E | 0.0022 | F |
| Comparative Example 8 | 7.77 | P | 6 | P | 0.100 | P | 0.0000 | G |
| Comparative Example 9 | 6.66 | P | 6 | P | 0.100 | P | 0.0000 | G |
| Comparative Example 10 | 0.05 | E | 34 | E | 0.005 | E | 0.0150 | P |

VTC: Variation of Toner Concentration
J: Judgment
E: Excellent;
G: Good;
F: Fair;
P: Poor
CQ: Charge Quantity
MV: Measured Value
SEC: Specific Energy Consumption

[Method of Evaluating Variation of Toner Concentration]

Ten-point sampling was evenly and randomly performed on the developer and the toner concentration was measured by a typical blow-off method using TB-200 from Toshiba Chemical Corp. A standard deviation a was calculated from the ten points and ranked.

Excellent (Usable): $\sigma<0.1$
Good (Usable): $0.1\leq\sigma<1.0$
Fair (Usable): $1.0\leq\sigma<5.0$
Poor (Unusable): $5.0\leq\sigma$

[Method of Evaluating Charge Quantity]

A specific amount of the developer was placed in a cage which is an electroconductive container having metallic meshes at both ends. From a nozzle, a compressed gas was sprayed to blow only the toner out of the cage. A charge Q of the carrier remaining in the cage was measured by a voltmeter. Further, the weight of the toner M was measured, and Q/M [−μc/g] was determined as a charge quantity per weight and ranked.

Excellent (Usable): $30\leq Q/M$
Good (Usable): $20\leq Q/M<30$
Fair (Usable): $10\leq Q/M<20$
Poor (Unusable): $Q/M\leq 10$

[Method of Evaluating Background Fouling]

The developer was set in a marketed and modified full-color printer imagio MP C5000 from Ricoh Company, Ltd to evaluate background fouling.

Specifically, the background potential was fixed at 150 V and development of a solid A3 image was started right after the developer was set. The development was forcibly stopped when the image was developed on a photoreceptor. Next, a transparent tape was attached to the part where the image was developed on the photoreceptor to transfer toner particles on the photoreceptor onto the transparent tape. Then, the transparent tape was attached onto a brand-new white paper and separated into 10 areas. The image density of the center of each of the areas was measured and averaged. The image density was measured by a spectrodensitometer X-Rite938 from X-Rite, Inc. The image density on the white paper was deduced from the image density on the transparent tape (only the density of the background fouling) to rank.

Excellent (Usable): $ID<0.01$
Good (Usable): $0.01\leq ID<0.03$
Fair (Usable): $0.03\leq ID<0.05$
Poor (Unusable): $0.05\leq ID$

[Method of Evaluating Specific Energy Consumption]

A ratio of an electric power applied for mixing to an output of the developer produced was ranked.

Good (Usable): $SEC<0.03$
Fair (Usable): $0.001\leq SEC<0.01$
Poor (Unusable): $0.01\leq SEC$ The developers in Examples 19 to 26 obviously improve in toner concentration, charge quantity and background fouling, compared with Comparative Examples 8 and 9, and decrease in specific energy consumption, compared with Comparative Example 10.

Embodiment 4

Figure 14:
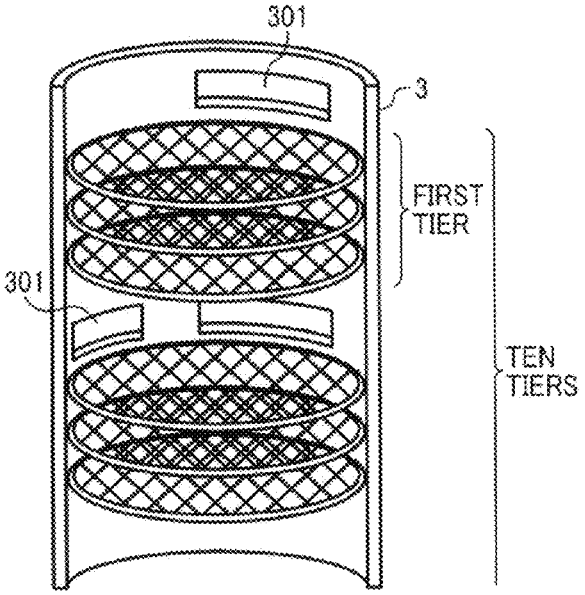
FIG. 14 is a schematic view illustrating a fall route of a part of a mixing pipe used in a gravity fall mixer of embodiment 4.

FIG. 14 is a schematic view illustrating a fall route of a part of a mixing pipe 3 used in a gravity fall mixer 100 of embodiment 4. The illustration of a half of the near side of the mixing pipe 3 is omitted such that the sifter-type direction control members 7 located inside can be seen.

As FIG. 14 shows, an air duct 301 is formed at a part of the mixing pipe 3.

Figure 15:
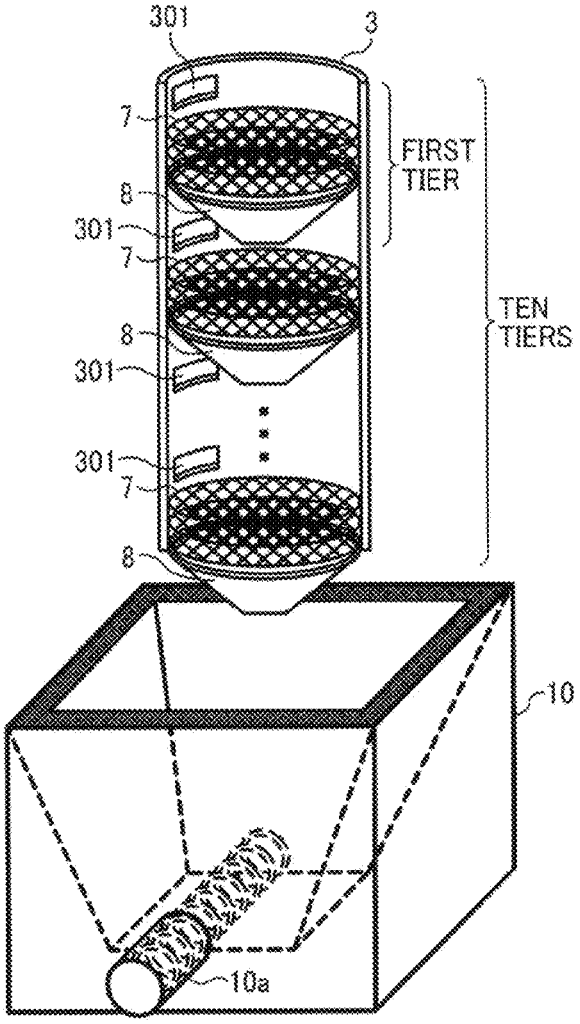
FIG. 15 is a schematic view illustrating a combination of the gravity fall mixer of embodiment 4 and a shearing mixer located below the mixing pipe of the gravity fall mixer.

FIG. 15 is a schematic view illustrating a combination of the gravity fall mixer 100 of and a shearing mixer 10 located below the mixing pipe 3 thereof. In the shearing mixer 10 in FIG. 15, a shear mixing transfer route 10*a* is a shearing force application part.

This mixes a carrier and a toner while falling with gravitational force. The carrier and the toner are fed in the static mixing pipe 3. They hit direction control members such as sifter-type, twisted-type and area-reduction type direction control members located therein and change in falling direction, and contact and frictionize each other. Therefore, they are mixed without consuming electric power to reduce exhaust of $CO_2$.

The mixing pipe 3 prevents the toner and the carrier from flying and scattering out thereof. Further, that flow densely and frequently contact each other, and their flows are complicated and mixing them is promoted.

However, when amounts of the toner and the carrier fed to plural direction control members are increased, they are likely to retain on the direction control members and are evenly present thereon, occasionally resulting in closed bottom of the direction control members.

When the bottom of the direction control members is closed, air cannot be fed in the mixing pipe 3 from outside. When many direction control members are vertically located, the lower the direction control member, the more difficult for air to pass. When air is difficult to pass, the toner and the carrier are also difficult to pass the direction control members. Pulsation when discharging, lowering of throughput and uneven mixture occurs, resulting in difficulty in improving production amount.

At least one air duct 301 in the mixing pipe 3 prevents the bottom of the direction control members from being closed to take air in from outside. Therefore, the carrier and the toner efficiently frictionize each other without reverse flushing and lowering speed of falling. Thus, pulsation when discharging, lowering of throughput and uneven mixture are prevented to improve production amount.

The gravity fall mixer 100 including the air duct 301 preferably includes the sifter-type direction control member 7 in FIG. 6 and the reducer-type direction control member 8 in FIG. 7. These direction control members complicate falling direction of the carrier and the toner, they hit each other more, and further mix each other. However, the direction control members prevent the toner and the carrier from falling, and they are likely to retain thereon and the bottom thereof is likely to be closed. The air duct 301 prevents the bottom of the direction control member from being closed.

In Embodiment 4, the sifter-type direction control member 7 and the reducer-type direction control member 8 in Embodiments 1 to 3 can be used.

The air duct 301 is an opened part of the outer wall of the route the carrier and the toner are falling through, and the shape, size and number thereof equalize inner pressure and atmospheric pressure.

Embodiment 4 includes plural units of a combination of the sifter-type direction control member 7 and the reducer-type direction control member 8, and the former is located above the latter. The combination of the reducer-type direction control member 8 and the sifter-type direction control member 7, the former is located after the latter efficiently mix the carrier and the toner. This is explained in Embodiment 3.

The air duct 301 is preferably located at every one unit or one direction control member. This is because of the following reason.

Air is taken more frequently to prevent closed status with the carrier and the toner, and they more efficiently frictionize each other.

Embodiment 4 may include an oscillator oscillating the mixing pipe 3 or the direction control member explained in Embodiment 3.

The gravity fall mixer 100 in Embodiment 4 includes the shearing mixer 10 below. Shearing force applied after mixing with gravity mixes the carrier and the toner better.

After the carrier and the toner fully substitute positions each other, a shearing force is applied thereto to strongly frictionize and charge them.

The shearing mixer 10 in Embodiment 4 is the same as the shearing mixer 10 in FIG. 10. In the shearing mixer 10, the carrier and the toner are mixed by shearing force application when frictionized between an inner wall of the tubular member and the screw member while transferred. They are frictionized between the transfer members when plurally located.

The carrier and the toner are mixed well as explained of FIG. 10 in Embodiment 2. The configuration of mixing with application of shearing force explained in Embodiment 2 can be used.

Experiment Example 4

Examples using Embodiment 4 and Comparative Examples not using Embodiment 4 are described.

Example 27

The Carrier 1 and the Toner 2 were mixed with each other in the following gravity fall mixer.

Specifically, the mixing pipe 3 in FIG. 1 was replaced with the mixing pipe 3 in FIG. 14. Ten (10) ducts 301 (1 cm×1 cm) were randomly formed on the mixing pipe 3, and 10 stages of 1 unit (stage) of overlapped 3 sifter-type direction control members 7 having an opening of 288 μm at an interval of 5 mm were located therein.

Above the mixing pipe 3, a carrier feeder 1 and a toner feeder 2 formed of ACCURATE FEEDER from KUMA engineering Co., Ltd. are located. The carrier feeder 1 and the toner feeder 2 fed Carrier 1 and Toner 2 at a mixing ratio (toner/carrier) of 7/93 by weight at 94.4 kghr. The carrier and the toner fall so as to all pass the direction control members 7 in the mixing pipe 3 to be mixed by the kinetic energy. Thus, Developer 37 having a toner concentration of 7% by weight was prepared.

Example 28

The procedure for preparation of Developer 37 in Example 27 was repeated except for further locating a reducer-type direction control member 8 having a reducing diameter of 9.0 mm below the overlapped 3 sifter-type direction control members 7 as a 1 unit to prepare Developer 38.

Example 29

The procedure for preparation of Developer 37 in Example 27 was repeated except for forming the 10 air ducts at each unit of the overlapped 3 sifter-type direction control members 7 to prepare Developer 39.

Example 30

The procedure for preparation of Developer 39 in Example 29 was repeated except for contacting a V-type vibrator from SINFONIA TECHNOLOGY CO., LTD to the direction control member from outside to prepare Developer 40.

Example 31

The procedure for preparation of Developer 40 in Example 30 was repeated except for locating a mortar-shaped container below the mixing pipe 3 to receive a developer having passed the mixing pipe 3 an applying a shearing force thereto with a pestle at 30 rpm to prepare Developer 41.

Example 32

The procedure for preparation of Developer 40 in Example 30 was repeated except for locating a shearing mixer 10 (FIG. 15) formed of a screw feeder feeding a developer at 93 rpm to prepare Developer 42. The developer was frictionized between a screw and an inner wall to be applied with a shearing force.

Example 33

Figure 16:
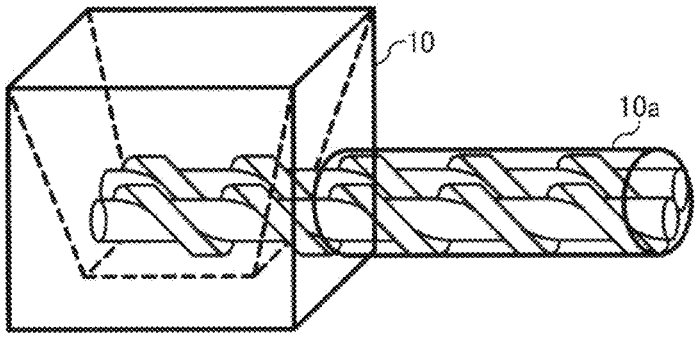
FIG. 16 is a schematic view illustrating a shearing mixer in Example 33.

The procedure for preparation of Developer 40 in Example 30 was repeated except for locating a shearing mixer 10 (FIG. 16) having two screws feeding a developer at 93 rpm to prepare Developer 43. The developer was frictionized between the screws to be applied with a shearing force.

Example 34

The procedure for preparation of Developer 43 in Example 33 was repeated except for changing the mixing ratio of the toner to the carrier into 9/1 by weight to prepare Developer 44. This is used for a developer for supply.

Comparative Example 11

The procedure for preparation of Developer 37 in Example 27 was repeated except for not forming the air duct 301 on the mixing pipe 3 to prepare Developer 45.

Comparative Example 12

The procedure for preparation of Developer 37 in Example 27 was repeated except for replacing the gravity fall mixer 100 with Tubular Mixer T2C from Shinmaru Enterprises Corp., having an electric power of 180 kWh. The mixing process was performed at 32 rpm for 7 min to prepare Developer 46.

Variation of toner concentration, charge quantity and background fouling of Developers 37 to 46 were evaluated. The power efficiency (specific energy consumption) and production amount in each of the mixing processes to prepare them were evaluated as well. The results are shown in Table 4.

TABLE 4

| | VTC | | CQ Q/M | | ID | | SEC MV | | PA PR | |
|---|---|---|---|---|---|---|---|---|---|---|
| | σ | J | [−μC/g] | J | MV | J | [kWh/kg] | J | [%] | J |
| Example 27 | 0.80 | F | 18 | F | 0.029 | G | 0.000 | G | 57 | G |
| Example 28 | 0.70 | F | 19 | F | 0.028 | G | 0.000 | G | 100 | G |
| Example 29 | 0.12 | F | 19 | F | 0.012 | G | 0.000 | G | 100 | G |
| Example 30 | 0.06 | G | 20 | G | 0.011 | G | 0.000 | G | 100 | G |
| Example 31 | 0.05 | G | 28 | G | 0.009 | E | 0.000 | G | 100 | G |
| Example 32 | 0.05 | G | 34 | E | 0.005 | E | 0.002 | F | 100 | G |
| Example 33 | 0.05 | G | 34 | E | 0.005 | E | 0.002 | F | 100 | G |
| Example 34 | 0.05 | G | 34 | E | 0.005 | E | 0.002 | F | 100 | G |
| Comparative Example 11 | 7.60 | P | 14 | F | 0.100 | P | 0.000 | G | 10 | P |
| Comparative Example 12 | 0.05 | G | 34 | E | 0.005 | E | 0.015 | P | 100 | G |

VTC: Variation of Toner Concentration
J: Judgment
E: Excellent;
G: Good;
F: Fair;
P: Poor
CQ: Charge Quantity
MV: Measured Value
SEC: Specific Energy Consumption
PA: Production Amount
PR: Processing Rate

[Method of Evaluating Variation of Toner Concentration]

Ten-point sampling was evenly and randomly performed on the developer and the toner concentration was measured by a typical blow-off method using TB-200 from Toshiba Chemical Corp. A standard deviation σ was calculated from the ten points and ranked.

Excellent (Usable): $\sigma<0.1$

Good (Usable): $0.1\leq\sigma<1.0$

Fair (Usable): $1.0\leq\sigma<5.0$

Poor (Unusable): $5.0\leq\sigma$

[Method of Evaluating Charge Quantity]

A specific amount of the developer was placed in a cage which is an electroconductive container having metallic meshes at both ends. From a nozzle, a compressed gas was sprayed to blow only the toner out of the cage. A charge Q of the carrier remaining in the cage was measured by a voltmeter. Further, the weight of the toner M was measured, and Q/M [−μc/g] was determined as a charge quantity per weight and ranked.

Excellent (Usable): $30\leq Q/M$

Good (Usable): $20\leq Q/M<30$

Fair (Usable): $10\leq Q/M<20$

Poor (Unusable): $Q/M\leq 10$

[Method of Evaluating Background Fouling]

The developer was set in a marketed and modified full-color printer imagio MP C5000 from Ricoh Company, Ltd to evaluate background fouling.

Specifically, the background potential was fixed at 150 V and development of a solid A3 image was started right after the developer was set. The development was forcibly stopped when the image was developed on a photoreceptor. Next, a transparent tape was attached to the part where the image was developed on the photoreceptor to transfer toner particles on the photoreceptor onto the transparent tape.

Then, the transparent tape was attached onto a brand-new white paper and separated into 10 areas. The image density of the center of each of the areas was measured and averaged. The image density was measured by a spectrodensitometer X-Rite938 from X-Rite, Inc. The image density on the white paper was deduced from the image density on the transparent tape (only the density of the background fouling) to rank.

Excellent (Usable): $ID<0.01$

Good (Usable): $0.01\leq ID<0.03$

Fair (Usable): $0.03\leq ID<0.05$

Poor (Unusable): $0.05\leq ID$

[Method of Evaluating Specific Energy Consumption]

A ratio of an electric power applied for mixing to an output of the developer produced was ranked.

Good (Usable): $SEC<0.03$

Fair (Usable): $0.001\leq SEC<0.01$

Poor (Unusable): $0.01\leq SEC$

[Method of Evaluating Production Amount]

A processing rate of processed amount per 1 hr to a feed amount 94.4 kg/hr (processed amount/feed amount) was ranked.

Good (Usable): 50≤Processing Rate

Poor (Unusable): Processing Rate<50

The developers in Examples 27 to 34 obviously improve in toner concentration, charge quantity and background fouling, compared with Comparative Example 11, and decrease in specific energy consumption, compared with Comparative Example 12.

Embodiment 5

Figure 17:
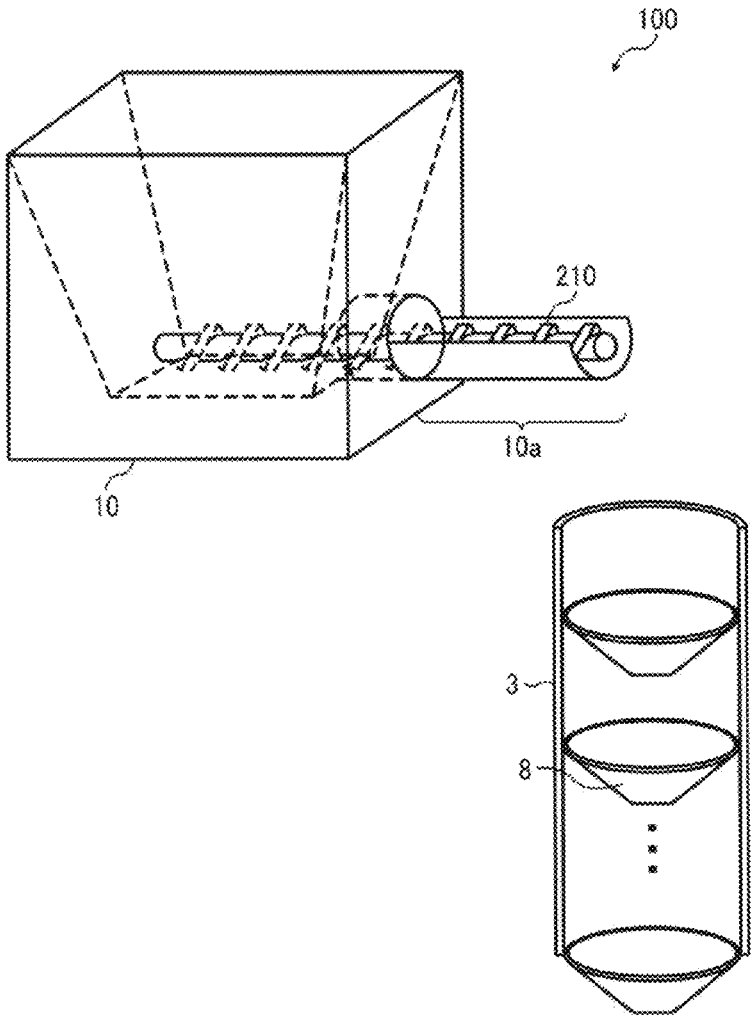
FIG. 17 is a schematic view illustrating a mixing pipe used in a gravity fall mixer of embodiment 5 and a shearing mixer.

FIG. 17 is a schematic view illustrating a mixing pipe 3 used in a gravity fall mixer 100 of Embodiment 5 and a shearing mixer 10. The gravity fall mixer 100 includes an unillustrated carrier feeder 1 and a toner feeder 2, feeding a carrier and a toner, respectively. The shearing mixer 10 includes a shear mixing transfer part resistor applying a resistance to a powder such as a toner fed by a transfer screw 210 as a transferer member located on a shear mixing transfer route 10*a*.

Embodiment 5 combines mixing using falling with gravity and mixing applying a shearing force. FIGS. 9 and 10 combine a method of mixing a carrier and a toner while falling with gravity and a method of mixing using an energy-saving stirrer driven only at a transfer part. This enables the resultant developer to have desired toner concentration and charge quantity at low environmental load.

The carrier and the toner mix each other with gravity without consuming electric power, which is very advantageous to the environment. A stirrer driving only a transfer member needs to have a long stirring distance to increase a toner concentration and a charge quantity of the developer, which is disadvantageous to cost and space.

The shear mixing transfer part resistor applies a resistance to a developer fed and the developer is blocked in the shear mixing transfer route 10*a*, and is applied with larger shearing force.

Therefore, the stirring distance for the developer to have desired toner concentration and charge quantity can be shortened. Namely, the length of the shear mixing transfer route 10*a* and a transfer distance of the transfer screw 210 need not be long. This can downsize the gravity fall mixer 100. In addition, the mixing efficiency is improved and the carrier and the toner are uniformly mixed to produce a developer without being poorly charged.

The shear mixing transfer part resistor includes narrowing a part of the wall surface of the transfer route of the developer and a member blocking transfer in the transfer route. Further, a magnetic or a wind force may be applied from outside of the transfer route. The shear mixing transfer part resistor blocks the developer to apply larger shearing force thereto, but is not limited thereto.

The transfer member may have the shape of a stick, a coil and a screw, but not limited thereto, which improves mixing efficiency, imparts larger charge quantity and shortens the transfer distance in some cases.

Figure 19:
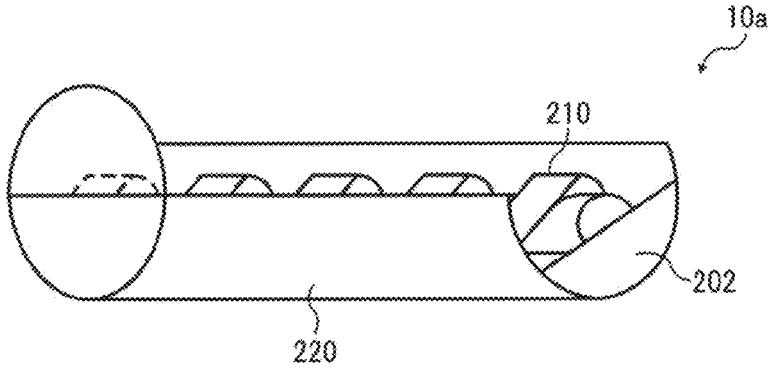
FIG. 19 is a schematic view illustrating a shear mixing transfer route of a shearing mixer in Example 36.
Figure 20:
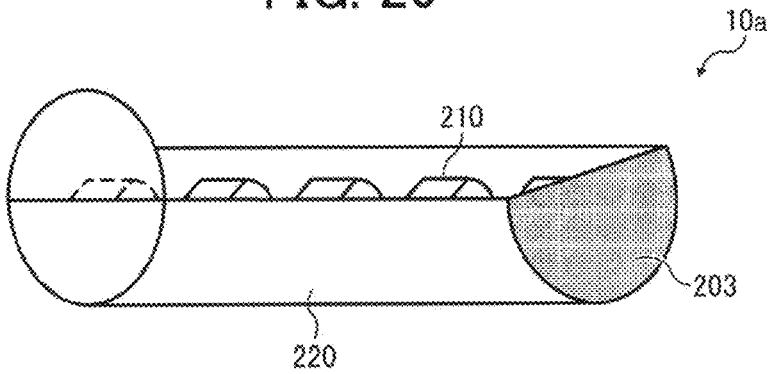
FIG. 20 is a schematic view illustrating a shear mixing transfer route of a shearing mixer in Example 37.

The shear mixing transfer part resistor includes at least one of transfer route direction control members such as a plate direction control member 202 in FIG. 19 and a mesh direction control member 203 in FIG. 20. The transfer route direction control members as the shear mixing transfer part resistor block a developer to be applied with a larger shearing force, which can shorten the stirring distance.

The transfer route direction control members may have the shape of a cone, a sphere and a plate. The shape, size, number, location interval and location can control the resistance. These improve mixing efficiency, imparts larger charge quantity and shortens the transfer distance in some cases, but are not limited thereto.

The mesh direction control member 203 in FIG. 20 is preferably used as the transfer route direction control member. The transfer route direction control members having other shaped cause uneven resistance to a developer. A developer passing the mesh direction control member evenly receives resistance.

The mesh direction control member 203 covers a part or all of the transfer route of a developer, and can control resistance with openings, numbers, location intervals and locations. These may be decided according to a developer and charge quantity. The mesh direction control member 203 is formed of negatively-chargeable materials such as TEFLON®, polypropylene and polyester, and positively-chargeable materials such as nylon and silk. These improve mixing efficiency, impart larger charge quantity and shorten the transfer distance in some cases, but are not limited thereto.

The mesh direction control member 203 preferably has an opening of from 100 to 1,000 μm. This enables a developer to pass the mesh direction control member 203 while preventing lowering transfer speed of the developer, and can apply a large shearing force without lowering a processed amount, which can shorten the transfer distance while keeping a specific energy consumption low. The mesh direction control member 203 preferably has an opening ratio of from 20 to 60% because of differentiating resistance, but is not limited thereto.

Figure 21:
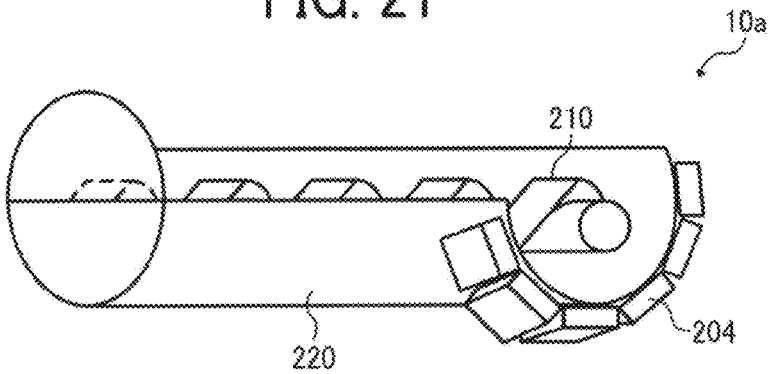
FIG. 21 is a schematic view illustrating a shear mixing transfer route of a shearing mixer in Example 41.

The shear mixing transfer part resistor may be a magnetic field generator as a magnet 204 in FIG. 21, applying a magnetic force from inside, outside or both sides of the transfer route. A developer is attracted to the magnetic force and a force resisting transfer is applied to the developer. A larger shearing force is applied thereto and the transfer distance can be shortened.

The magnet 204 includes a ferrite magnet, a metallic magnet, a bond magnet, an electromagnet, etc. The magnetic strength largely improves resistance to the transfer, imparts larger charge quantity and shortens the transfer distance in some cases. The transfer member may be a magnet, and angular or a ring magnet may be located around the transfer route. These are controlled according to a developer and charge quantity, which imparts larger charge quantity and shortens the transfer distance in some cases, but are not limited thereto.

Experiment Example 5

Examples using Embodiment 5 and Comparative Examples not using Embodiment 5 are described.

Example 35

The Carrier 1 and the Toner 2 were mixed with each other in the gravity fall mixer 100 of Embodiment 5. Specifically, from an unillustrated carrier feeder and an unillustrated toner feeder of the gravity fall mixer 100 in FIG. 17, the carrier and the toner 2 were fed to the shearing mixer 10 in FIG. 17.

Figure 18:
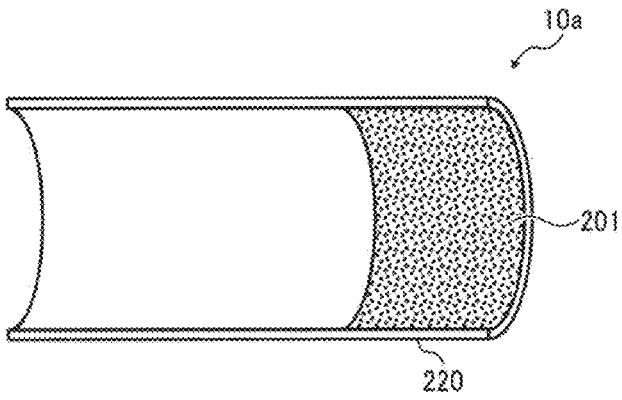
FIG. 18 is a schematic view illustrating a shear mixing transfer route of a shearing mixer in Example 35.

FIG. 18 is schematic view illustrating a shear mixing transfer route 10*a* of a shearing mixer 10 in Example 35.

The shear mixing transfer route 10*a* has an inner diameter of 20 mm and includes a semicylindrical transfer route forming member 220 bulging below, and a surface roughened part 201 subjected to surface roughening with sand blast on an inner surface of the transfer route forming member 220 from an exhaust side end to a length of 10 mm. The surface roughened part 201 is a resistance to transfer of the transfer screw 210 and works as a shear mixing transfer part resistor. The transfer screw 210 rotated at 160 rpm.

Below the exhaust side end of the transfer route forming member 220, a mixing pipe 3 including 10 stages of the reducer-type direction control member 8 was located. The unillustrated carrier feeder and the unillustrated toner feeder formed of ACCURATE FEEDER from KUMA engineering Co., Ltd. fed Carrier1 and Toner 2 at a mixing ratio (toner/carrier) of 7/93. Thus, Developer 47 was prepared.

Example 36

FIG. 19 is schematic view illustrating a shear mixing transfer route 10*a* of a shearing mixer 10 in Example 36. The shear mixing transfer route 10*a* includes a plate direction control member 202 working as a shear mixing transfer part resistor at an exhaust side end of the transfer route forming member 220 so as to cover a lower half of a semicircular cross-section. The procedure for preparation of Developer 47 in Example 35 was repeated except for forming the plate direction control member 202 instead of the surface roughened part 201 to prepare Developer 48.

Example 37

FIG. 20 is schematic view illustrating a shear mixing transfer route 10*a* of a shearing mixer 10 in Example 37. The shear mixing transfer route 10*a* includes a mesh direction control member 203 at an exhaust side end of the transfer route forming member 220 so as to cover a semicircular cross-section. The mesh direction control member 203 had an opening of 98 μm and an opening ratio of 19%. The procedure for preparation of Developer 48 in Example 36 was repeated except for forming the mesh direction control member 203 instead of the plate direction control member 202 to prepare Developer 49.

Example 38

The procedure for preparation of Developer 49 in Example 37 was repeated except for changing the opening into 100 μm and the opening ratio into 20% of the mesh direction control member 203 to prepare Developer 50.

Example 39

The procedure for preparation of Developer 49 in Example 37 was repeated except for replacing the carrier 1 with a carrier 2 which is a Cu—Zn burned ferrite core material coated with the film forming liquid to have a film thickness of 0.3 μm to prepare Developer 51.

Example 40

The procedure for preparation of Developer 51 in Example 39 was repeated except for changing the opening into 1,000 μm and the opening ratio into 60% of the mesh direction control member 203 to prepare Developer 52.

Example 41

FIG. 21 is schematic view illustrating a shear mixing transfer route 10*a* of a shearing mixer 10 in Example 41. The shear mixing transfer route 10*a* includes cubic magnets 204 at the edges of the semicylindrical transfer route forming member 220. The procedure for preparation of Developer 47 in Example 35 was repeated except for forming the magnets 204 instead of the surface roughened part 201 to prepare Developer 53.

Example 42

Figure 22:
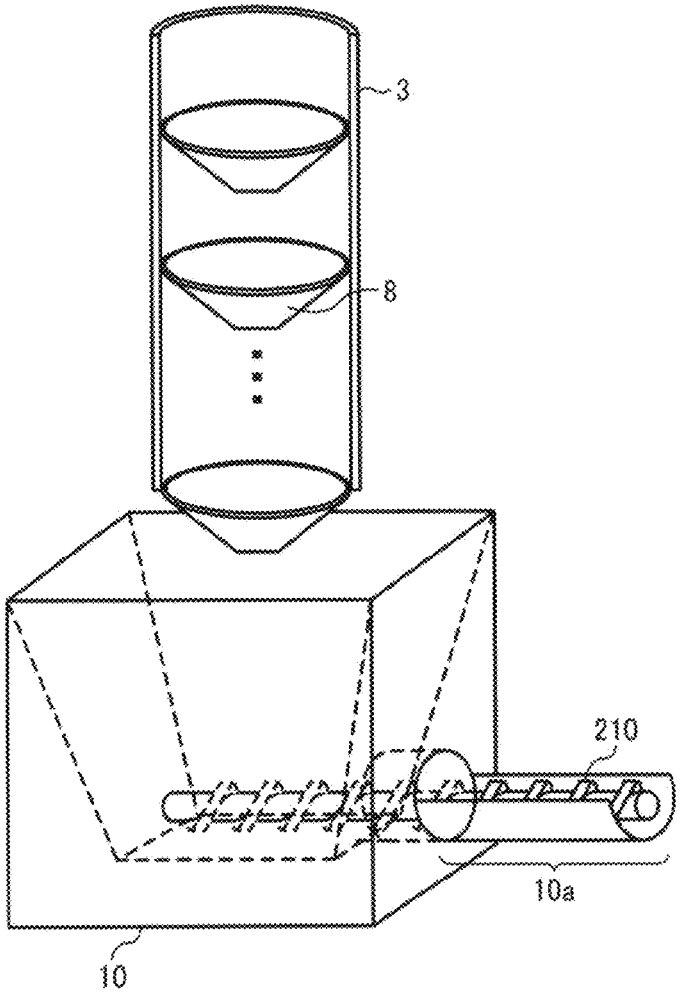
FIG. 22 is a schematic view illustrating a shear mixing transfer route of a shearing mixer in Example 42.

FIG. 22 is a schematic view illustrating a mixing pipe 3 and a shearing mixer 10 used in a gravity fall mixer 100 in Example 42. The procedure for preparation of Developer 47 in Example 35 was repeated except for interchanging the mixing pipe 3 and the shearing mixer 10 to prepare Developer 54.

Example 43

Figure 23:
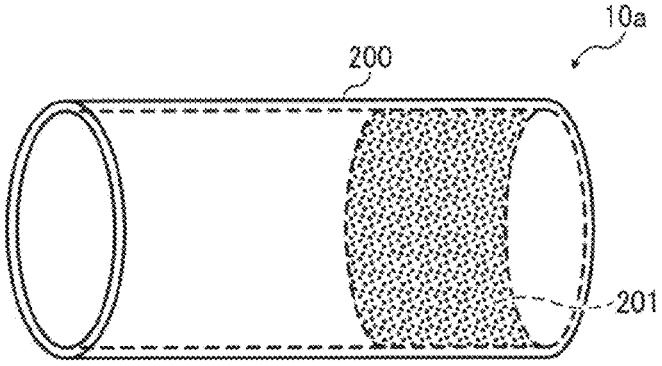
FIG. 23 is a schematic view illustrating a shear mixing transfer route of a shearing mixer in Example 43.

FIG. 23 is schematic view illustrating a shear mixing transfer route 10*a* of a shearing mixer 10 in Example 43. The procedure for preparation of Developer 47 in Example 35 was repeated except for replacing the semicylindrical transfer route forming member 220 with a cylindrical transfer route forming member 220 which is closed except its feed and exhaust ends to prepare Developer 55.

Example 44

Figure 24:
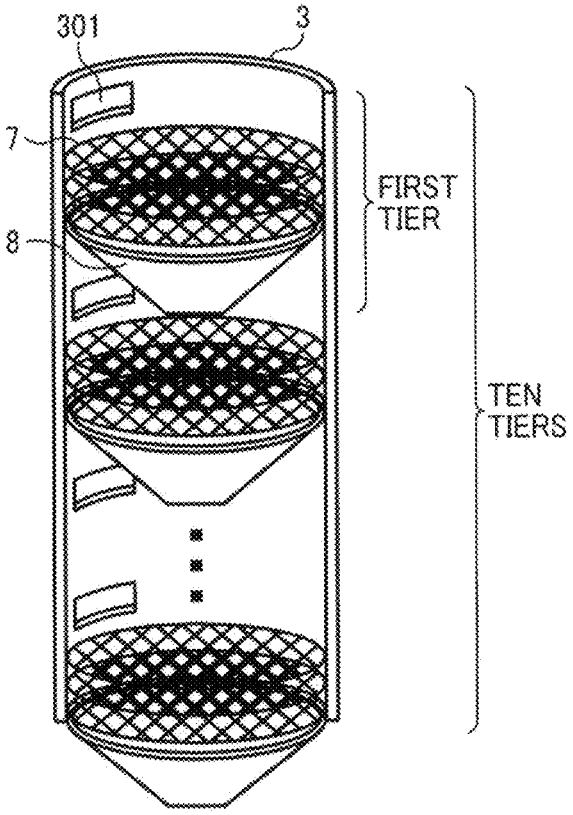
FIG. 24 is a schematic view illustrating a shear mixing transfer route of a shearing mixer in Example 44.

FIG. 24 is a schematic view illustrating a mixing pipe 3 used in a gravity fall mixer 100 in Example 44. The mixing pipe 3 includes 10 stages of 1 unit of 3 sifter-type direction control members 7 parallely located at intervals of 5 mm, having an opening of 288 μm and 1 reducer-type direction control member 8 having a reducing diameter of 9.0 mm below the overlapped 3. The procedure for preparation of Developer 47 in Example 35 was repeated except for replacing the mixing pipe 3 with the above mixing pipe 3 to prepare Developer 56.

Example 45

The procedure for preparation of Developer 47 in Example 35 was repeated except for changing the mixing ratio of the toner to the carrier into 9/1 by weight to prepare Developer 57. This is used for a developer for supply.

Comparative Example 13

The procedure for preparation of Developer 47 in Example 35 was repeated except for replacing the gravity fall mixer 100 with Tubular Mixer T2C from Shinmaru Enterprises Corp., having an electric power of 180 kWh. The mixing process was performed at 32 rpm for 7 min to prepare Developer 58.

Comparative Example 14

The procedure for preparation of Developer 47 in Example 35 was repeated except for not forming the surface roughened part 201 on an inner surface of the transfer route forming member 220 to prepare Developer 59.

In Examples 35 to 45 and Comparative Examples 13 and 14, developers having desired toner concentration (σ: 0.10 or less) and charge quantity (Q/M: 30 or more) were prepared. The specific energy consumption and the stirring distance (length of the transfer route forming member 220) then were evaluated. The results are shown in Table 5.

TABLE 5

| | Specific Energy Consumption | | Stirring Distance | |
|---|---|---|---|---|
| | Measured Value [kWh/kg] | Judgment | Measured Value [m] | Judgment |
| Example 35 | 0.0022 | Good | 0.9 | Fair |
| Example 36 | 0.0022 | Good | 0.8 | Fair |
| Example 37 | 0.0029 | Fair | 0.3 | Good |
| Example 38 | 0.0022 | Good | 0.4 | Good |

TABLE 5-continued

| | Specific Energy Consumption | | Stirring Distance | |
|---|---|---|---|---|
| | Measured Value [kWh/kg] | Judgment | Measured Value [m] | Judgment |
| Example 39 | 0.0018 | Good | 0.8 | Fair |
| Example 40 | 0.0022 | Good | 0.4 | Good |
| Example 41 | 0.0022 | Good | 0.9 | Fair |
| Example 42 | 0.0022 | Good | 0.6 | Fair |
| Example 43 | 0.0022 | Good | 0.4 | Good |
| Example 44 | 0.0022 | Good | 0.4 | Good |
| Example 45 | 0.0022 | Good | 0.9 | Fair |
| Comparative Example 13 | 0.0150 | Poor | — | — |
| Comparative Example 14 | 0.0022 | Good | 1.2 | Poor |

[Method of Evaluating Specific Energy Consumption (SEC)]

A ratio of an electric power applied for mixing to an output of the developer produced was ranked.

Good (Usable): SEC≤0.0022

Fair (Usable): 0.0022<SEC≤0.0030

Poor (Unusable): 0.0030<SEC

[Method of Evaluating Stirring Distance (SD)]

Good (Usable): SD≤0.5

Fair (Usable): 0.5<SD≤1.0

Poor (Unusable): 1.0<SD

The developers in Examples 35 to 45 obviously improve in specific energy consumption, compared with Comparative Example 13, and in stirring distance, compared with Comparative Example 14.

Having now fully described the invention, it will be apparent to one of ordinary skill in the art that many changes and modifications can be made thereto without departing from the spirit and scope of the invention as set forth therein.

What is claimed is:

1. A method of preparing a developer, comprising:

falling a carrier and a toner through a mixing pipe with gravity, thereby mixing the carrier and the toner; and controlling a direction of the falling with a falling direction controller positioned in the mixing pipe, wherein the falling direction controller comprises at least one of a twisted member and a sifter member.

2. The method of claim 1, wherein the falling direction controller comprises a combination of the sifter member and an area-reduction member located thereafter.

3. The method of claim 2, wherein the falling direction controller further comprises the twisted member.

4. The method of claim 2, wherein the falling direction controller comprises a plurality of the combination.

5. The method of claim 1, further comprising:

oscillating the carrier and the toner in the mixing pipe with an oscillator.

6. The method of claim 1, wherein the carrier and the toner simultaneously fall through the mixing pipe.

7. The method of claim 1, wherein the mixing pipe comprises an opening connecting an outside and an inside of the mixing pipe.

8. The method of claim 7, wherein the falling direction controller comprises a plurality of an unit, the unit comprising one or a plurality of the twisted member, one or a plurality of the sifter member, a combination of the twisted member and the sifter member, or the combination of the sifter member and the area-reduction member, and the mixing pipe comprises the opening in each of the units.

9. The method of claim 1, further comprising:

applying a shearing force to the carrier and the toner.

10. The method of claim 9, wherein the shearing force is applied to the carrier and the toner after falling the carrier and the toner through the mixing pipe.

11. The method of claim 10, further comprising:

transferring the carrier and the toner through a transfer route with a transfer member positioned in the transfer route; and applying a resistance to the carrier and the toner transferred in the transfer route with a resistor.

12. The method of claim 11, wherein the resistor is a transfer direction controller controlling directions of the carrier and the toner in the transfer route.

13. The method of claim 12, wherein the transfer direction controller is a mesh member.

14. The method of claim 13, wherein the mesh member comprises an opening of from 100 to 1,000 μm.

15. The method of claim 11, wherein the resistor is a magnetic field generator generating a magnetic force in the transfer route.

16. The method of claim 11, wherein the transfer route is formed by a transfer route forming member, and the shearing force is applied by friction to the carrier and the toner when the carrier and the toner are transferred between the transfer route forming member the transfer member.

17. The method of claim 3, wherein the twisted member is positioned between the sifter member and the area-reduction member.

18. The method of claim 8, wherein the unit comprises the sifter member and the twisted member.

19. The method of claim 9, wherein the shearing force is applied to the carrier and the toner when the carrier and the toner are transferred through a transfer route with a transfer member positioned in the transfer route.

20. The method of claim 16, wherein the transfer route forming member comprises a tubular member, a disc member, and a cylinder member.

* * * * *